US007158735B2

(12) United States Patent
Murayama et al.

(10) Patent No.: US 7,158,735 B2
(45) Date of Patent: Jan. 2, 2007

(54) PROCESS CARTRIDGE, MOUNTING METHOD OF ELECTROPHOTOGRAPHIC PHOTOSENSITIVE DRUM AND REPLACING METHOD OF THE PHOTOSENSITIVE DRUM

(75) Inventors: Kazunari Murayama, Shizuoka-ken (JP); Kanji Yokomori, Odawara (JP); Hideki Maeshima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 294 days.

(21) Appl. No.: 10/875,200

(22) Filed: Jun. 25, 2004

(65) Prior Publication Data

US 2005/0117934 A1 Jun. 2, 2005

(30) Foreign Application Priority Data

Nov. 28, 2003 (JP) ..... 2003-400776

(51) Int. Cl.
*G03G 15/00* (2006.01)

(52) U.S. Cl. ..... 399/111; 399/117

(58) Field of Classification Search ..... 399/109, 399/111, 116, 117

See application file for complete search history.

(56) References Cited

U.S. PATENT DOCUMENTS 4,823,160 A * 4/1989 Ikuta et al. ..... 399/117
5,128,715 A * 7/1992 Furuyama et al. ..... 399/116
5,534,972 A * 7/1996 Ohno ..... 399/75
5,825,472 A 10/1998 Araki et al. ..... 355/200
5,839,028 A 11/1998 Nomura et al. ..... 399/109
5,878,309 A 3/1999 Nomura et al. ..... 399/111
5,943,528 A 8/1999 Akutsu et al. ..... 399/110
5,953,562 A * 9/1999 Kawaguchi et al. ..... 399/117
5,993,101 A * 11/1999 Kohno et al. ..... 403/305
6,029,031 A 2/2000 Yokomori et al. ..... 399/109
6,055,406 A 4/2000 Kawai et al. ..... 399/360
6,064,843 A 5/2000 Isobe et al. ..... 399/111
6,131,011 A 10/2000 Kojima et al. ..... 399/351
6,215,969 B1 4/2001 Nomura et al. ..... 399/111
6,266,503 B1 7/2001 Murayama et al. ..... 399/117
6,289,189 B1 9/2001 Numagami et al. ..... 399/111
6,381,430 B1 4/2002 Yokomori et al. ..... 399/119
6,385,416 B1 5/2002 Horikawa et al. ..... 399/111
6,442,359 B1 8/2002 Numagami et al. ..... 399/111
6,459,869 B1 10/2002 Nittani et al. ..... 399/111
6,463,232 B1 10/2002 Kawai et al. ..... 399/111
6,463,233 B1 10/2002 Kojima et al. ..... 399/111

(Continued)

FOREIGN PATENT DOCUMENTS

JP 60-142382 A 7/1985

(Continued)

*Primary Examiner*—Robert Beatty
(74) *Attorney, Agent, or Firm*—Fitzpatrick, Cella, Harper & Scinto

(57) ABSTRACT

A process cartridge detachably mountable to a main assembly of an electrophotographic image forming apparatus includes an electrophotographic photosensitive drum, a process device actable on the drum, a drum frame, first and second drum frame openings at a different longitudinal ends of the drum frame, first and second end regulating portions at different longitudinal ends of the drum frame, a drum shaft with a through hole, a drum end flange with an end flange opening for receiving the drum shaft, first and second openings provided opposite from each other at a periphery of the end flange opening, and a connecting member penetrating the first opening and the through hole and engaged with the second opening to connect the photosensitive drum with the drum shaft. The regulating portions regulate the position of the drum in its longitudinal direction and the connecting member connects the drum shaft with the drum.

7 Claims, 15 Drawing Sheets

U.S. PATENT DOCUMENTS

| | | | | |
|---|---|---|---|---|
| 6,463,234 | B1 | 10/2002 | Arimitsu et al. | 399/113 |
| 6,463,235 | B1 * | 10/2002 | Yamanaka et al. | 399/117 |
| 6,480,687 | B1 | 11/2002 | Kawai et al. | 399/111 |
| 6,549,738 | B1 * | 4/2003 | Otani et al. | 399/117 |
| 6,577,831 | B1 | 6/2003 | Kojima et al. | 399/111 |
| 6,608,980 | B1 | 8/2003 | Murayama et al. | 399/111 |
| 6,684,041 | B1 | 1/2004 | Yokomori et al. | 399/167 |
| 6,714,752 | B1 | 3/2004 | Ueno et al. | 399/117 |
| 6,996,354 | B1 * | 2/2006 | Kimura et al. | 399/121 |
| 2002/0057928 | A1 | 5/2002 | Yasumoto et al. | 399/167 |
| 2002/0085854 | A1 | 7/2002 | Numagami et al. | 399/90 |
| 2003/0156855 | A1 | 8/2003 | Nittani et al. | 399/24 |
| 2003/0156856 | A1 | 8/2003 | Arimitsu et al. | 399/114 |
| 2003/0185587 | A1 | 10/2003 | Kawai et al. | 399/111 |
| 2004/0005169 | A1 | 1/2004 | Yokomori et al. | 399/117 |

FOREIGN PATENT DOCUMENTS

| | | | | |
|---|---|---|---|---|
| JP | 60-194628 | U | | 12/1985 |
| JP | 64-24363 | U | | 2/1989 |
| JP | 6-2365 | U | | 1/1994 |
| JP | 06-083122 | A | | 3/1994 |
| JP | 2000231302 | A | * | 8/2000 |
| JP | 2002-207395 | A | | 7/2002 |
| KR | 0159133 | | | 3/1999 |

* cited by examiner

PROCESS CARTRIDGE, MOUNTING METHOD OF ELECTROPHOTOGRAPHIC PHOTOSENSITIVE DRUM AND REPLACING METHOD OF THE PHOTOSENSITIVE DRUM

FIELD OF THE INVENTION AND RELATED ART

The present invention relates to a process cartridge detachably mountable to an electrophotographic image forming apparatus, a mounting method of the electrophotographic photosensitive drum in the process cartridge, and a replacing method of the electrophotographic photosensitive drum in the process cartridge.

Here, an electrophotographic image forming apparatus is an apparatus which forms an image on recording medium with the use of an electrophotographic image forming process. As examples of the electrophotographic image forming apparatus, there are an electrophotographic copying machine, an electrophotographic printer (for example, laser (beam) printer, LED printer, etc.), and a facsimile machine.

A process cartridge is a cartridge which is removably mountable in the main assembly of an image forming apparatus, and in which at least one of a charging means, a developing means and a cleaning means, as a processing means, and an electrophotographic photosensitive drum, are integrally disposed.

FIG. 15 shows a schematic structure of a color laser printer as an example of a color electrophotographic image forming apparatus utilizing an electrophotographic image forming process.

With respect to the color laser printer, in recent years, a faster and inexpensive machine has been developed. In order to realize a high-speed machine, an inline-type color printer which effects formation of a plurality of color images at the same time has been adopted.

Referring to FIG. 15, this color laser printer is provided with four process cartridges (20Y, 20M, 20C and 20K) constituting four image forming stations PY, PM, PC and PK for yellow Y, magenta M, cyan C, and black K, respectively. Further, the process cartridges (20Y, 20M, 20C and 20K) include electrophotographic photosensitive drums (21Y, 21M, 21C and 21K), respectively, as a first image bearing member. Respective visible images (toner images) formed on the photosensitive drums are transferred sequentially onto an intermediary transfer member 40*a* as a second image bearing member in a multiple superposition manner. Thus, a full-color print image can be obtained.

In this case, when the process cartridges (20Y, 20M, 20C and 20K) are vertically stacked, it is possible to reduce the mounting area. Further, such a stacked disposition is advantageous for space saving in an office and is effective in personalizing the color laser printer.

In this color laser printer, an intermediary transfer member unit 40 including the intermediary transfer member 40*a* is provided on an opening and closing cover 10 side of the printer. When the opening and closing cover 10 is opened, a user can access the process cartridges to dismount and mount the process cartridges.

In a conventional process cartridge, e.g., as described in U.S. Pat. No. 6,266,503, a photosensitive drum has been held by a photosensitive drum holding shaft supported by side covers at both sides of a frame.

On the other hand, in the image forming apparatus, the process cartridge is used in the main assembly of the image forming apparatus, so that the size of the image forming apparatus main assembly is largely affected by the size of the process cartridge. Accordingly, a size reduction of the process cartridge has been required.

SUMMARY OF THE INVENTION

An object of the present invention is to provide a process cartridge capable of reducing its size in a longitudinal direction of a photosensitive drum.

Another object of the present invention is to provide a process cartridge which is reduced in the number of parts and is inexpensive.

A further object of the present invention is to provide a process cartridge which cam simplify its assembly steps.

A still further objects of the present invention is to provide a mounting method of an electrophotographic photosensitive drum constituting the process cartridge, and a replacing method of the electrophotographic photosensitive drum constituting the process cartridge.

According to the present invention, there is provided a process cartridge detachably mountable to a main assembly of an electrophotographic image forming apparatus, comprising:

an electrophotographic photosensitive drum, process means actable on the electrophotographic photosensitive drum, a drum frame rotatably supporting the electrophotographic photosensitive drum, a first drum frame opening provided at a first longitudinal end of the drum frame, a second drum frame opening provided at a second longitudinal end of the drum frame, a first end regulating portion provided at the first longitudinal end of the drum frame, a second end regulating portion provided at the second longitudinal end of the drum frame, a drum shaft which is penetrated through the electrophotographic photosensitive drum to be engaged with first drum frame opening and the second drum frame opening and is provided with a through hole extending in a direction perpendicular to the drum shaft, a first end flange provided at a first end of the electrophotographic photosensitive drum, a first end flange opening, provided to the first end flange, for permitting penetrating of the drum shaft therethrough, a first opening and a second opening which are provided opposite from each other at a periphery of the first end flange opening in a direction perpendicular to a longitudinal direction of the electrophotographic photosensitive drum, and a connecting member which is penetrated through the first opening and the through hole and engaged with the second opening to connect the electrophotographic photosensitive drum with the drum shaft, wherein the first end regulating portion and the second end regulating portion regulate the position of the electrophotographic photosensitive drum in its longitudinal direction and the connecting member connects the drum shaft with the electrophotographic photosensitive drum so that the electrophotographic photosensitive drum is supported rotatably to the drum frame with the drum shaft.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinafter, preferred embodiments of the present invention with respect to a process cartridge, a photosensitive drum mounting method, and a photosensitive drum replacing method will be described with reference to the drawings.

Embodiment 1

[Description of General Structure of Image Forming Apparatus]

First, the general structure of a color image forming apparatus as an image forming apparatus in which a process cartridge according to an embodiment of the present invention is detachably mountable will be described.

In this embodiment, the color image forming apparatus is a four-drum type inline color laser (beam) printer.

Figure 1:
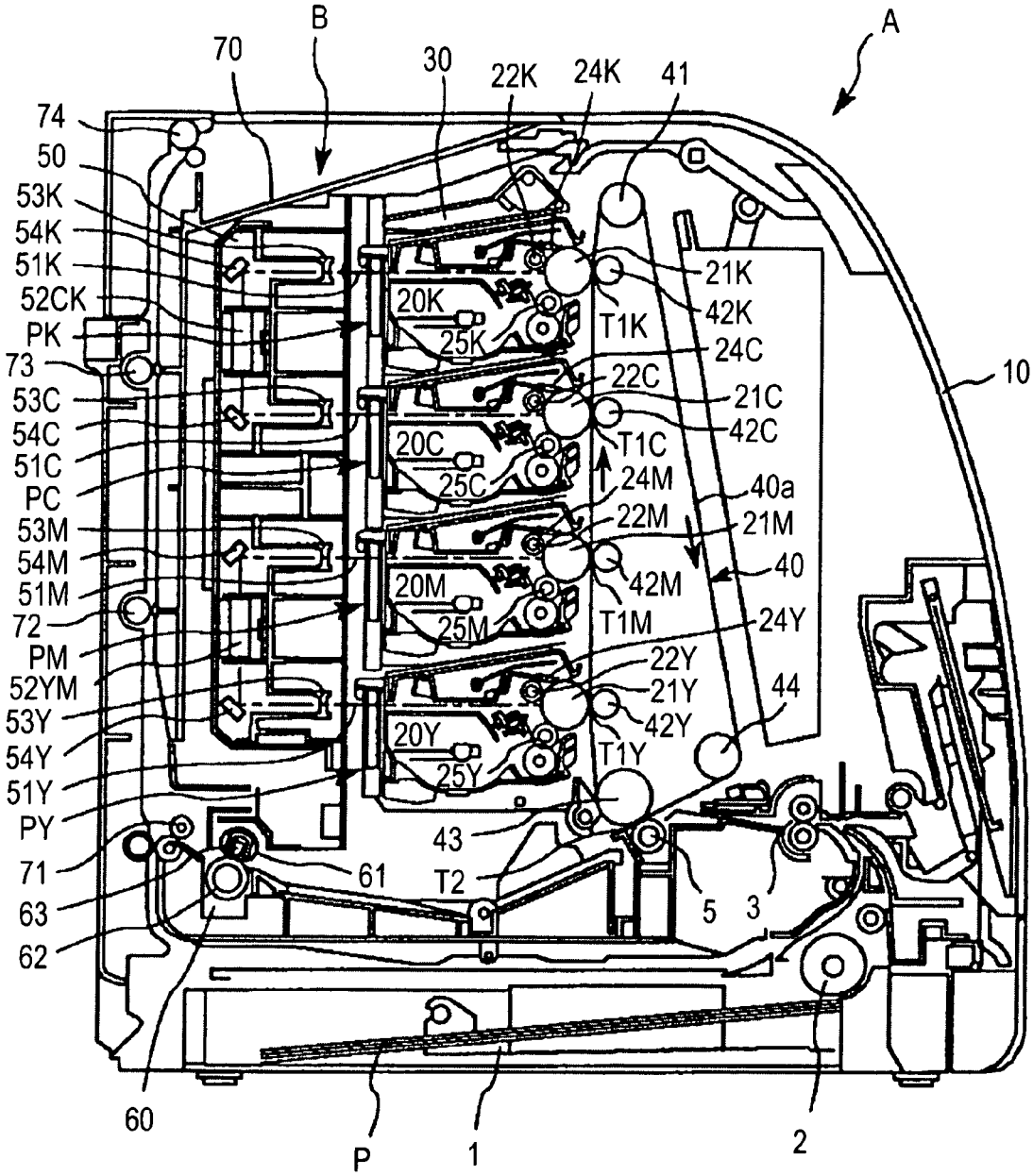
FIG. 1 is a schematic sectional view showing the structure of an image forming apparatus according to an embodiment of the present invention.

As shown in FIG. 1, a color laser printer A includes four process cartridges 20 (20Y, 20M, 20C and 20K) constituting four image forming stations PY, PM, PC and PK for yellow Y, magenta M, cyan C and black K, respectively. Further, the color laser printer A includes an intermediary transfer member unit 40 for holding a color image formed through multiple superposition of transferred visible images (toner image) which have been formed in the respective image forming stations PY, PM, PC and PK. The process cartridges 20 for four colors are independently detachably mountable to a printer main assembly B.

Figure 2:
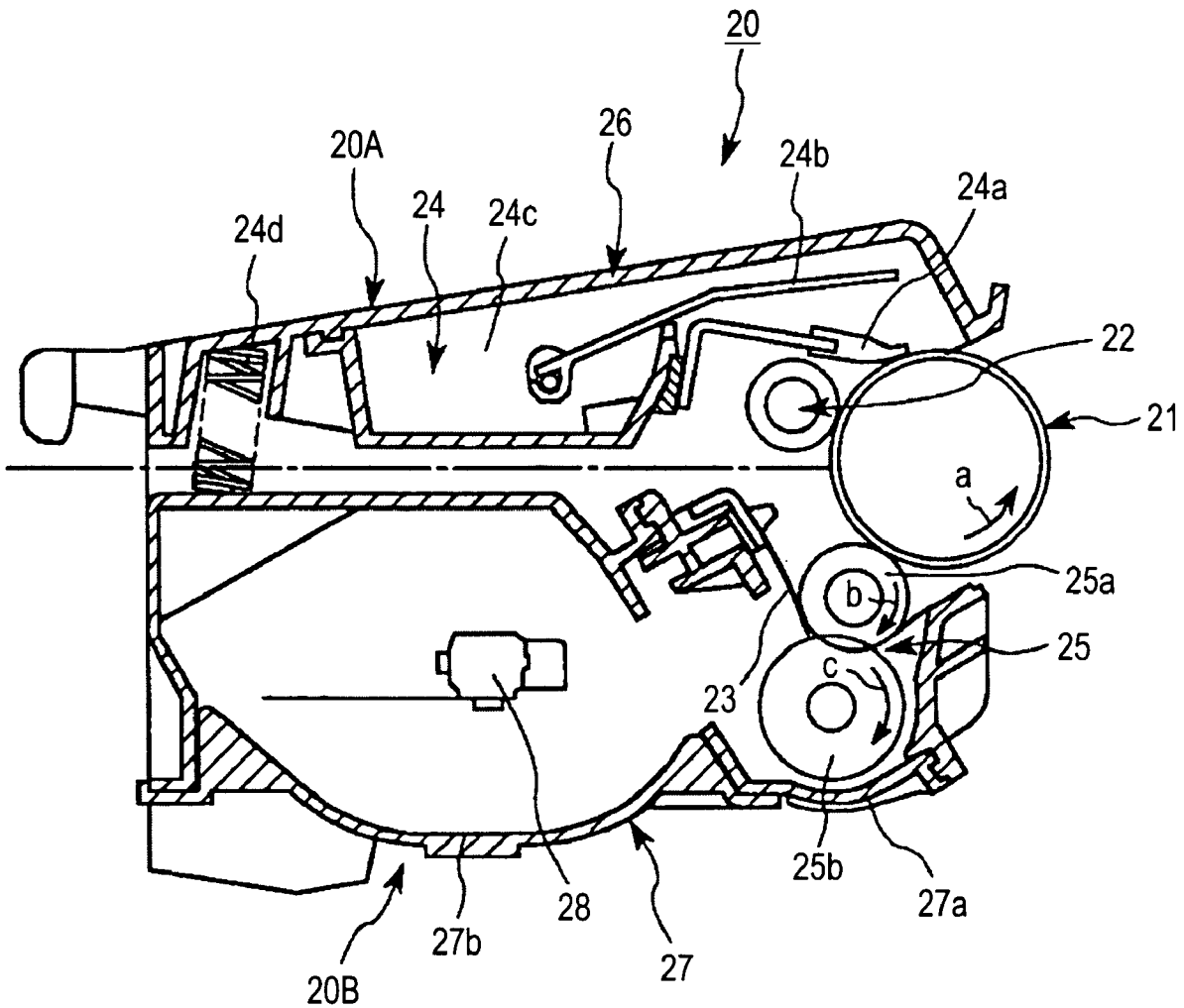
FIG. 2 is a schematic sectional view showing a structure of a process cartridge.

As is well understood also with reference to FIG. 2, each of the process cartridges 20 (20Y, 20M, 20C and 20K) is provided with a photosensitive drum 21 (21Y, 21M, 21C, 21K) as an image bearing member. Around the photosensitive drum 21, the process cartridge 20 includes a charging means 22 (22Y, 22M, 22C, 22K), a developing means 25 (25Y, 25M, 25C, 25K), and a cleaning means 24 (24Y, 24M, 24C, 24K), thus forming a toner image. An exposure means 50 is provided to the apparatus main assembly B. The intermediary transfer member unit 40 conveys the color toner image held thereon to a transfer position, where the color toner image is transferred from the intermediary transfer member unit 40 onto a recording medium P fed from a feeding station 1.

The recording medium P onto which the color toner image has been transferred is conveyed to a fixation station 60 in which the color toner image is fixed on the recording medium P. The recording medium P is then discharged onto a delivery tray 70 on the top surface of the apparatus by discharge rollers 71, 72, 73 and 74.

Next, structures of respective means or members of the above-described image forming apparatus will be successively described in detail.

[Process Cartridge]

First, the structure of the process cartridges 20 (20Y, 20M, 20C and 20K) will be described. Each of the process cartridges 20 (20Y, 20M, 20C and 20K) has the same structure.

FIG. 2 is a sectional view of the process cartridge 20. The process cartridge 20 includes developer (toner) which decreases in amount with continuous use, while effecting image formation, and an electrophotographic photosensitive drum 21 which is gradually deteriorated with continuous use. The process cartridge 20 further includes integrally supported process parts, as replacement parts, such as a charge roller 22 as a charging means, and a development roller 25*a* or the like constituting a developing means 25. The photosensitive drum 21, the charging means 22 and the developing means 25 will be described later more specifically. When the toner amount is reduced to a critical level, the process parts are replaced with new process parts to always maintain a high level of image quality.

In the inline type full-color image forming apparatus in this embodiment, four process cartridges 20 (20Y, 20M, 20C and 20K) for four colors of yellow Y, magenta M, cyan C and black K are used independently from each other. By providing the independent process cartridges for four colors, it is possible to efficiently use process cartridges whose service lives are different, depending on the images to be outputted.

Figure 3:
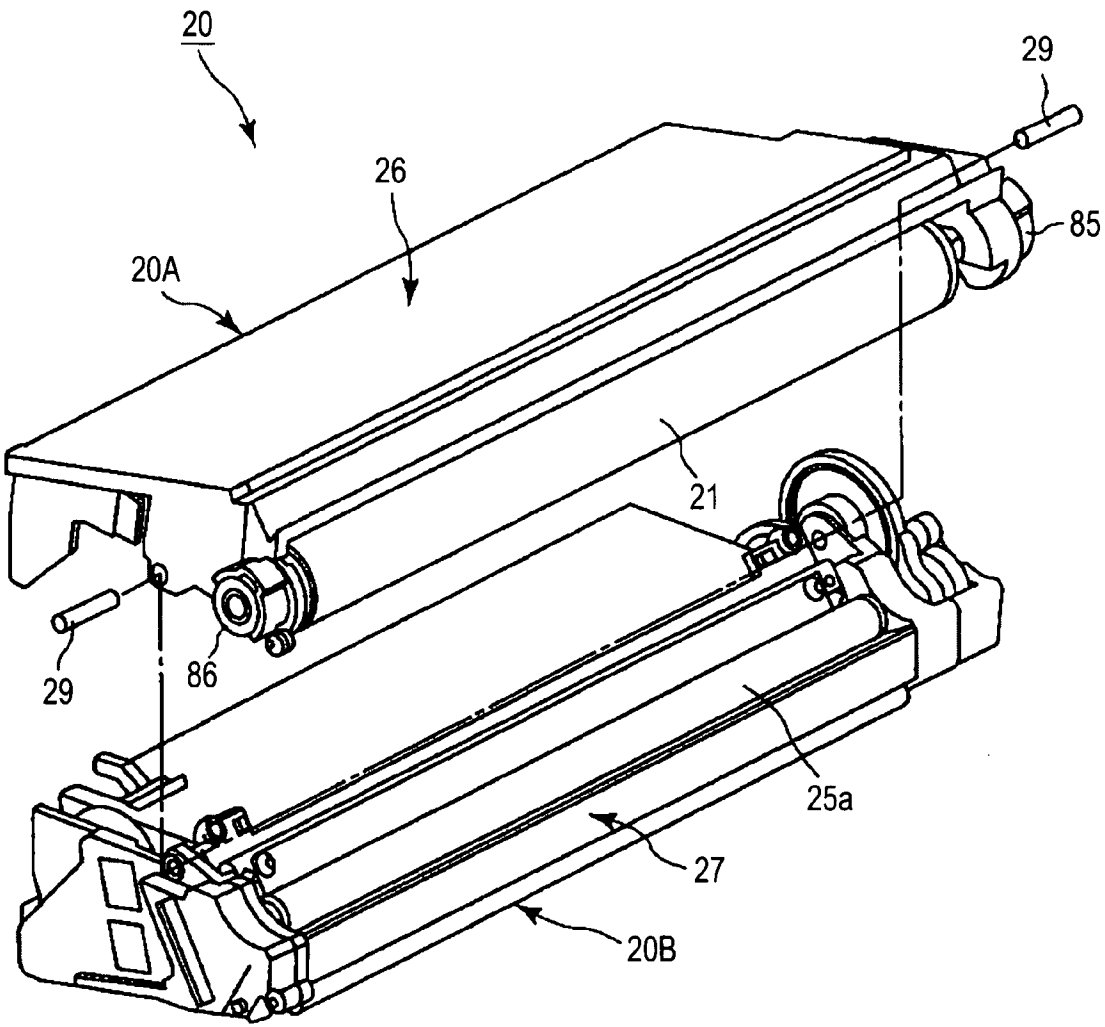
FIG. 3 is a schematic sectional view showing a state that a process cartridge is separated into a photosensitive drum unit and a development unit.

Next, the process cartridges 20 (20Y, 20M, 20C and 20K) will be described also with reference to FIG. 3. FIG. 3 is a schematic perspective view of the process cartridge 20 (20Y, 20M, 20C, 20K). The process cartridge 20 includes a photosensitive drum unit 20A comprising the photosensitive drum 21, the charging means 22, and the cleaning means 25, and a development unit 20B comprising the developing means 25 for developing an electrostatic latent image on the photosensitive drum 21.

The photosensitive drum unit 20A is rotatably mounted to a drum frame 26 through bearings 85 and 86. Around the photosensitive drum 21, the charge roller 22 (primary charging means) for uniformly charging the surface of the photosensitive drum 21, and a cleaning blade 24*a* for removing developer (toner) remaining on the photosensitive drum 21, are disposed. The residual toner removed from the photosensitive drum 21 surface by the cleaning blade 24*a* is successively conveyed into a waste toner chamber 24*c* disposed in a rearward portion of the drum frame 26 by a toner conveying mechanism 24*b*.

Figure 12:
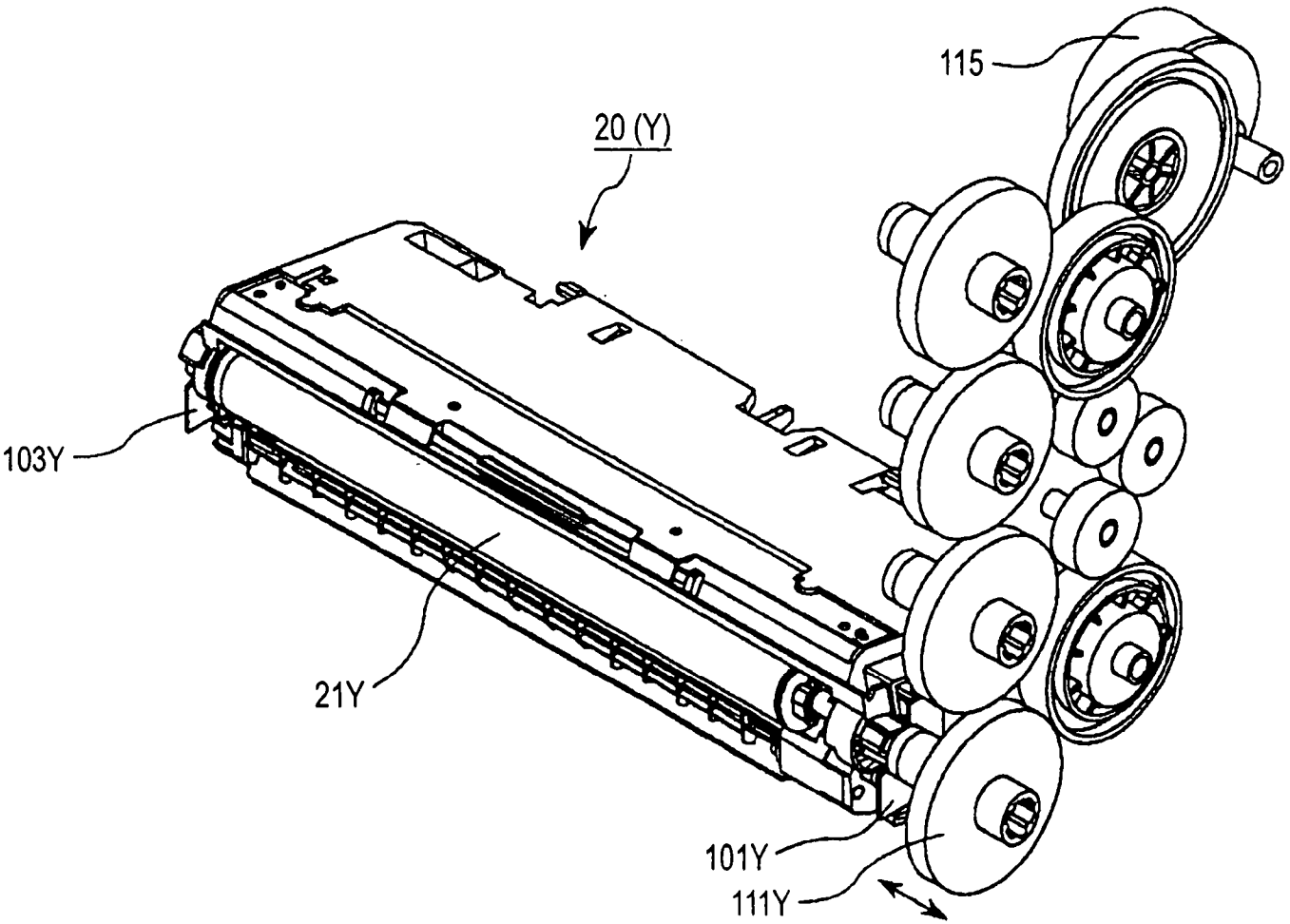
FIG. 12 and FIG. 13 are respectively a schematic perspective view showing positioning of a process cartridge and a schematic perspective view showing the supporting state of the photosensitive drums according to an embodiment of the present invention.
Figure 13:
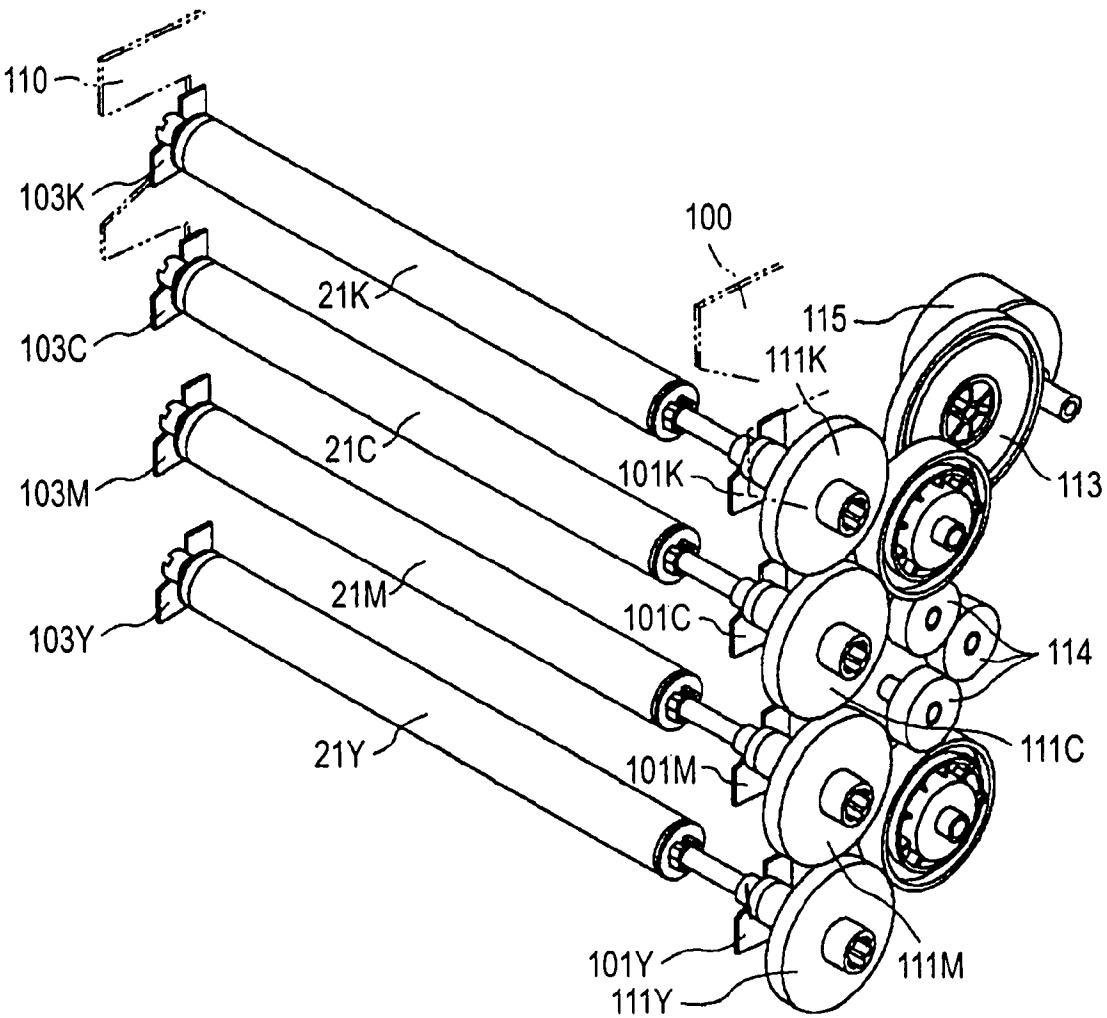

The photosensitive drum 21 transmits a driving force of a drive motor 115 shown in FIGS. 12 and 13 through a drive gear train, and is rotated in a direction of an arrow a indicated in FIG. 2 in correspondence with image forming operation.

The development unit 20B includes a development container 27 constituting a development frame. The developer container 27 includes a development chamber 27*a* provided with a development roller 25*a* rotated in contact with the photosensitive drum 21 in a direction of an arrow b, and a toner container 27*b* containing developer (toner).

The development roller 25*a* is rotatably supported by the development container 27. On the peripheral surface of the development roller 25*a*, a developer (toner) supply roller 25*b* rotated in contact with the development roller 25*a* in a direction of an arrow c, and a developing blade 23, are disposed.

In the toner container 27*b* is a toner conveying member 28, which stirs the toner contained and conveys the toner to the toner supply roller 25*b*.

The photosensitive drum unit 20A and the development unit 20B are connected by a fixing pin 29 to have such a suspension structure that the entire development unit 20B is pivotally supported by the photosensitive drum unit 20A. Further, the development unit 20B is, in such a state that the process cartridge is not mounted in the apparatus main assembly, always urged by a pressure spring 24*d* so that the development roller 25*a* contacts the photosensitive drum 21 due to rotation moment about the fixing pin 29.

[Photosensitive Drum]

Each of the photosensitive drums 21 (21Y, 21M, 21C, 21K) in this embodiment comprises an aluminum cylinder, and a layer of organic photosensitive substance coated on the peripheral surface of the aluminum cylinder. The photosensitive drum 21 is incorporated in the photosensitive drum unit 20A, i.e., the drum frame 26, and integrally constitutes the process cartridge 20 together with the development unit 20B.

The respective process cartridges 20 (20Y, 20M, 20C, 20K) are detachably mountable to the printer main assembly and readily allow unit replacement in correspondence with the end of life of the photosensitive drums 21 (21Y, 21M, 21C, 21K).

The mounting method or the like of the photosensitive drum 21 used in the present invention will be described later.

[Charging Means]

A charging means 22 (22Y, 22M, 22C, 22K) is used in a contact charging scheme, wherein a roller-shaped electroconductive charger roller 22 is caused to contact the surface of the photosensitive drum 21 while being supplied with a voltage. By doing so, the peripheral surface of the photosensitive drum 21 is uniformly charged by the charge roller 22.

[Exposing Means]

The photosensitive drum 21 is exposed by a scanner portion constituting an exposure means 50 as shown in FIG. 1. The exposure means 50 in this embodiment is provided with two polygon mirrors (52YM and 53CK) constituting an integral scanner with respect to the four image forming stations PY, PM, PC and PK. As image formation signals are sequentially given to a laser diode (unshown), the laser diode projects a beam of image formation light (51Y, 51M, 51C, 51K) reflecting the image formation signals to the polygon mirror (52YM, 52CK), which is being rotated at a high speed. The image formation light is reflected (deflected) by the polygon mirror (52YM, 52CK), and then, is reflected (deflected) by a reflective mirror (54Y, 54M, 54C, 54K). Then, the image formation light 51 is guided through the focal lens (53Y, 53M, 53C, 53K) onto the peripheral surface of the photosensitive drum 21, which is being rotated a predetermined peripheral velocity. As the image formation light reaches the peripheral surface of the photosensitive drum 21, the peripheral surface of the photosensitive drum 21 is selectively exposed to image light, forming thereby an electrostatic latent image on the peripheral surface of the photosensitive drum 21.

[Developing Means]

The developing means 25 (25Y, 25M, 25C and 25K) contain, as described above, color developers (color toners) of yellow Y, magenta M, cyan C, and black K, respectively, for visualizing the electrostatic latent image, in an associated toner container 27*b*.

During development, the contained toner is conveyed to the toner supply roller 25*b* by the toner conveying member 28. The toner supply roller 25*b* rotated in the arrow c direction and the development roller 25*a* rotated in the arrow b direction rub against each other, so that the toner on the toner supply roller 5*b* is supplied to the development roller 25*a* to be held on the development roller 25*a*.

The toner held on the development roller 25*a* reaches a position of the developing blade 23 by the rotation of the development roller 25*a*. The developing blade 23 regulates the toner at the position to impart a desired electric charge for charging to the toner and forms the toner in a thin layer. The regulated toner is conveyed to a developing station, at which the photosensitive drum and the development roller 25*a* contact each other, by the rotation of the development roller 25*a*. In the developing station, the toner is moved from the development roller 25*a* to the photosensitive drum 21 by a DC developing bias voltage applied from a power source (unshown) to the development roller 25*a*, thus developing the latent image on the photosensitive drum 21 to provide a visible image (toner image).

The toner remaining on the surface of the development roller 25*a* is peeled off and recovered by the toner supply roller 25*b*. The recovered toner is mixed with the toner, which has not been subjected to development, under stirring by the toner conveying member 28.

In the contact developing scheme in which the development roller 25*a* contacts the photosensitive drum 21 to effect development as in this embodiment, it is preferable that the photosensitive drum 21 is a rigid body and the development roller 25*a* is a roller-shaped elastic body. As the elastic body, it is possible to use, e.g., a single layer of a solid rubber or a solid rubber layer coated with a resinous layer in view of a charge imparting performance to the toner.

[Intermediary Transfer Member]

The intermediary transfer member 40*a* constituting the intermediary transfer member unit 40 is a member onto which multiple images formed of developers on the photosensitive drums 21, by the respective developing means 25, one for one, are transferred in layers during color image formation. The intermediary transfer member 40*a* is circularly driven in the clockwise direction (FIG. 1) at the same peripheral velocity as that of the photosensitive drum 21.

After being formed on the photosensitive drums 21, the toner images are positioned opposite to the photosensitive drum 21 via the intermediary transfer member 40*a* and are transferred in layers onto the intermediary transfer member 40*a* in primary transfer stations (T1Y, T1M, T1C and T1K) as contact points with primary transfer rollers (42Y, 42M, 42C, and 42Bk), one for one.

After the multiple images formed of developers are transferred in layers onto the intermediary transfer member 40*a*, the intermediary transfer member 40*a* and secondary transfer roller 5 nip the recording medium P at a secondary transfer station T2 between them, and together convey the recording medium P. As a result of voltage application to the secondary transfer roller 5, the respective color toner images on the intermediary transfer member 40*a* are transferred all at once onto the recording medium P.

The intermediary transfer member 40*a* in this embodiment is a seamless resin belt with a circumferential dimension of roughly 620 mm. It is stretched around a driving roller 41, intermediary transfer member backing roller 43, and tension roller 44, being thereby supported by them. The tension roller 44 is kept pressured outward of the loop, which the intermediary transfer member 40*a* forms, by the pressure applied to the lengthwise ends of the roller 44. With the provision of this structural arrangement, should the circumferential dimension of the intermediary transfer member 40*a* change due to the changes in the internal temperature and/or humidity, and the elapse of time, the change is absorbed by this structural arrangement, whereby the amount of the tension to which the intermediary transfer member 40*a* is subjected remains virtually constant.

A rubber-made guide rib (unshown) is adhered to the intermediary transfer member 40*a* with an adhesive at an entire one side edge of its inner peripheral surface. At one end portion of the tension roller 44, an unshown flange of resin having a slope is disposed. The guide rib (unshown) and the flange (unshown) regulate movement (deviation) of the intermediary transfer member 40*a* in a direction perpendicular to the moving direction of the intermediary transfer member 40*a*.

Further, the intermediary transfer member 40*a* is pivotally held to the main assembly of the apparatus (printer), being allowed to pivot about the rotational axis of the driving roller 41. The driving force from a motor (unshown) is transmitted to the back end (FIG. 1) of the driving roller 41, circularly rotating the intermediary transfer member 40*a* in the clockwise direction (FIG. 1) in synchronism with image formation.

[Feeding Station]

The feeding station is a station for conveying recording mediums P to the image forming stations. It comprises a cassette 1 capable of containing a plurality of recording media P, a (paper) feeding roller 2, and a pair of registration rollers 3, etc.

During image formation, the feeding roller 2 is rotationally driven in synchronism with image formation, whereby the recording mediums P in the cassette 1 are fed one by one out of the cassette 1, toward the pair of registration rollers 3, which carries out in a predetermined sequence, the process for keeping the recording medium P on standby and the process for conveying the recording medium P toward the intermediary transfer member 40*a*, in order to make the recording medium P align with the images on the intermediary transfer member 40*a* during a subsequent image transfer process.

[Transfer Station]

The transfer station has a secondary transfer roller 5, which is pivotable and formed of a metal shaft and a medium-resistance elastic body wound a bent the metal shaft. The transfer roller 5 is rotationally driven, and is roughly vertically movable (FIG. 1). In synchronism with the timing of transferring the color images onto the recording medium P, the transfer roller 5 is pressed upward, i.e., pressed against the intermediary transfer member 40*a* by a cam (unshown) onto the recording medium P with the application of a predetermined amount of pressure, with the recording medium P nipped between the intermediary transfer member 40*a* and transfer roller 5. Simultaneously, this time, a bias voltage is applied to the transfer roller 5. As a result, the toner images formed on the intermediary transfer member 40*a* are transferred onto the recording medium P. Incidentally, the intermediary transfer member 40*a* and transfer roller 5 are driven independently from each other. Therefore, after the transfer process, the recording medium P, which has been kept sandwiched by the intermediary transfer member 40*a* and transfer roller 5 during the transfer process, is conveyed leftward (FIG. 1), reaching a subsequent fixing station 60.

[Fixation Station]

In the fixation station 60, the color toner images formed on the recording medium P are fixed to the recording medium P by a fixing device, which comprises a film guide unit 61 and a pressure roller 62. The film guide unit 61 contains a ceramic heater 63 for heating the recording medium P. The pressure roller 62 is for pressing the recording medium P against the film guide unit 61. With the provision of this structural arrangement, the recording medium P carrying thereon the toner images is conveyed by the film guide unit 61 and the pressure roller 62 and is subjected to heat and pressure, whereby the color toner images are fixed to the recording medium P.

[Image Forming Operation]

Next, the operation for forming an image with the use of the apparatus structured as described above will be described.

First, the feed roller 2 shown in FIG. 1 is rotated, conveying thereby one of the recording media P in the cassette 1 to the pair of registration rollers 3.

Meanwhile, the photosensitive drum 21 and intermediary transfer member 40*a* are rotated independently from each other, in the direction indicated by the arrow (FIG. 1) at a predetermined peripheral velocity V (which hereinafter will be referred to as the process speed).

After being charged by the charging means 22 across its peripheral surface, the photosensitive drum 21 is exposed to the beam of laser light (image formation light). As a result, an electrostatic latent image is formed on the peripheral surface of the photosensitive drum 21.

1: Formation of Yellow Image

A latent image corresponding to the yellow color component of a target image is formed by exposing the peripheral surface of the photosensitive drum 21Y to the beam of laser light 51Y, corresponding to the yellow color component of the target image, projected from the scanner portion 50. In synchronism with the formation of this latent image, the yellow development roller 23Y is rotated while voltage, the polarity of which is the same as that of the photosensitive drum 21Y, is applied to the yellow development roller 23Y in order to adhere yellow developer to the latent image on the photosensitive drum 21Y, that is, in order to develop the latent image with the yellow developer. The developed latent image, that is, an image formed of yellow developer, is transferred (primary transfer) onto the peripheral surface of the intermediary transfer member 40*a*, at the location at which the transfer roller 42Y is kept pressed against the photosensitive drum 21Y, with the intermediary transfer member 40*a* being sandwiched between the transfer roller 42Y and photosensitive drum 21Y. The primary transfer is effected by applying a voltage, of a polarity opposite to that of the yellow toner, to the intermediary transfer member 40*a*.

2: Formation of Magenta Image

Next, irradiation of the photosensitive drum 21M with laser light 51M, corresponding to the magenta image, is started by the scanner portion 50 so that the leading edge of the latent image is aligned with the leading edge of the yellow image on the peripheral surface of the intermediary transfer member 40*a*. Similarly as in the case of the yellow image, the magenta toner image is developed with respect to the latent image on the photosensitive drum 21M. Then, the magenta toner image on the photosensitive drum 21M is transferred and overlaid onto the yellow toner image on the intermediary transfer member 40*a* at an opposing portion where the photosensitive drum 21M and a primary transfer roller 42M are opposed to each other through the intermediary transfer member 40*a*.

3: Formation of Cyan Image

Next, irradiation of the photosensitive drum 21C with laser light 51C, corresponding to the cyan image, is started by the scanner portion 50 so that the leading edge of the latent image is aligned with the leading edge of the yellow/magenta image on the peripheral surface of the intermediary transfer member 40*a*. Similarly as in the case of the magenta image, the cyan toner image is developed with respect to the latent image on the photosensitive drum 21C. Then, the cyan toner image on the photosensitive drum 21C is transferred and overlaid onto the yellow and magenta toner images on the intermediary transfer member 40*a* at an opposing portion where the photosensitive drum 21C and a primary transfer roller 42C are opposed to each other through the intermediary transfer member 40*a*.

4: Formation of Black Image

Next, irradiation of the photosensitive drum 21K with laser light 51K, corresponding to the magenta image, is started by the scanner portion 50 so that the leading edge of the latent image is aligned with the leading edge of the yellow/magenta/cyan image on the peripheral surface of the intermediary transfer member 40*a*. Similarly as in the case of the cyan image, the black toner image is developed with respect to the latent image on the photosensitive drum 21K. Then, the black toner image on the photosensitive drum 21K is transferred and overlaid onto the yellow, magenta and cyan toner images on the intermediary transfer member 40*a* at an opposing portion where the photosensitive drum 21K and a primary transfer roller 42K are opposed to each other through the intermediary transfer member 40*a*.

As described above, the latent image formation, the development, and the transfer of the toner image onto the intermediary transfer member 40*a*, at an associated opposing portion of the primary transfer roller 42 is sequentially carried out for the yellow, magenta, cyan, and black color components of the target image, in this order. As a result, a full-color image formed of four toners, that is, yellow, magenta, cyan, and black toners, is formed on the surface of the intermediary transfer member 40.

Incidentally, prior to the completion of the primary transfer of the black toner image, the leading edge of which reaches the secondary transfer station T2 on the intermediary transfer member 40*a*, the recording medium P, which has been kept on standby by the pair of registration rollers 3, is conveyed at a predetermined timing.

Except for the period in which the four color images are transferred onto the intermediary transfer member 40*a*, the transfer roller 5 is kept at the bottom position, being away from the intermediary transfer member 40*a*. However, immediately prior to the transfer of the four color images onto the intermediary transfer member 40*a*, the transfer roller 5 is moved upward by a cam (unshown) in order to keep the recording medium P pressed against the intermediary transfer member 40*a* by the transfer roller 5, in the second transfer station T2, while the four images are transferred. Further, during the secondary transfer of the four color images, a bias voltage opposite in polarity to the toners is continuously applied to the transfer roller 5. As a result, the four color images, which make up a full-color image, on the intermediary transfer member 40*a*, are transferred all at once onto the recording medium P.

Thereafter, the recording medium P is separated from the intermediary transfer member 40*a*, and is conveyed to the fixation station 60, in which the toner images are fixed. Then, the recording medium P is discharged onto the delivery tray 70 on top of the main assembly of the printer, by the four pairs 71, 72, 73, and 74 of the discharge rollers, ending the operation for forming a full-color image on one of the recording media P.

[Mounting Method of Photosensitive Drum]

Next, the mounting method of the photosensitive drum 21 according to an embodiment of the present invention will be described in detail with reference to FIGS. 4 to 7.

Figure 4:
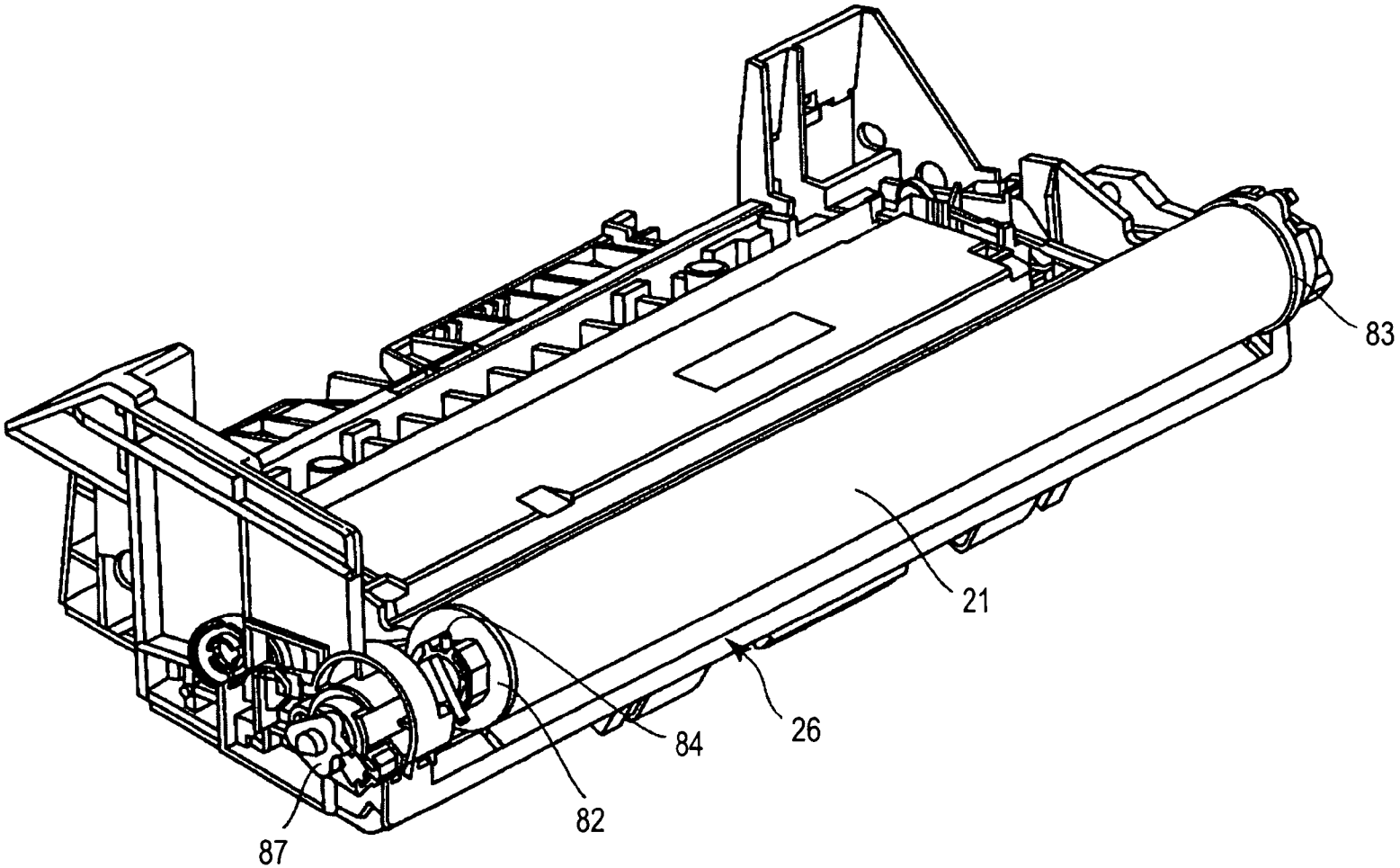
FIG. 4 is a perspective view of the photosensitive drum unit separated from the development unit.
Figure 5:
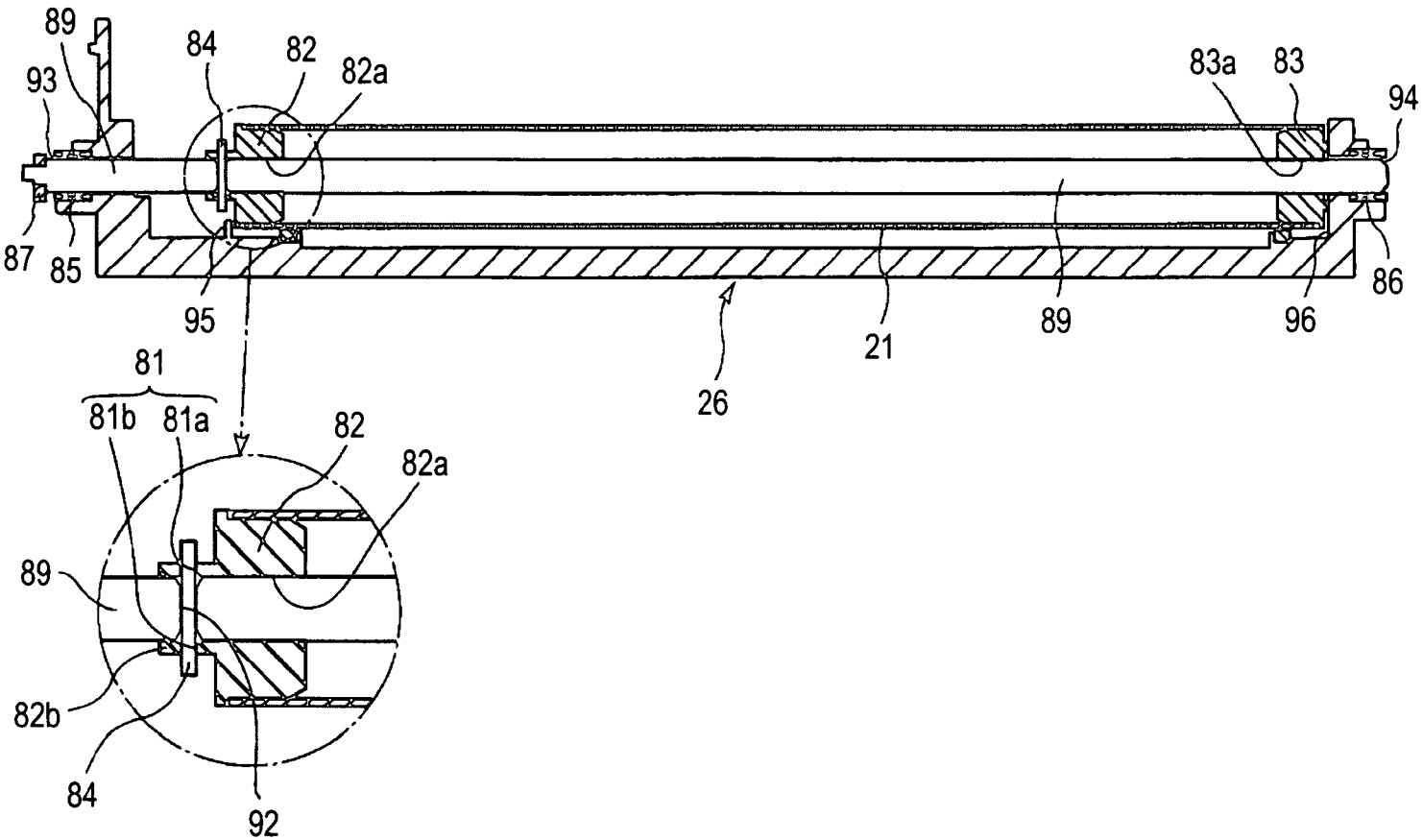
FIG. 5 is a sectional view showing a structure of a photosensitive drum.
Figure 6:
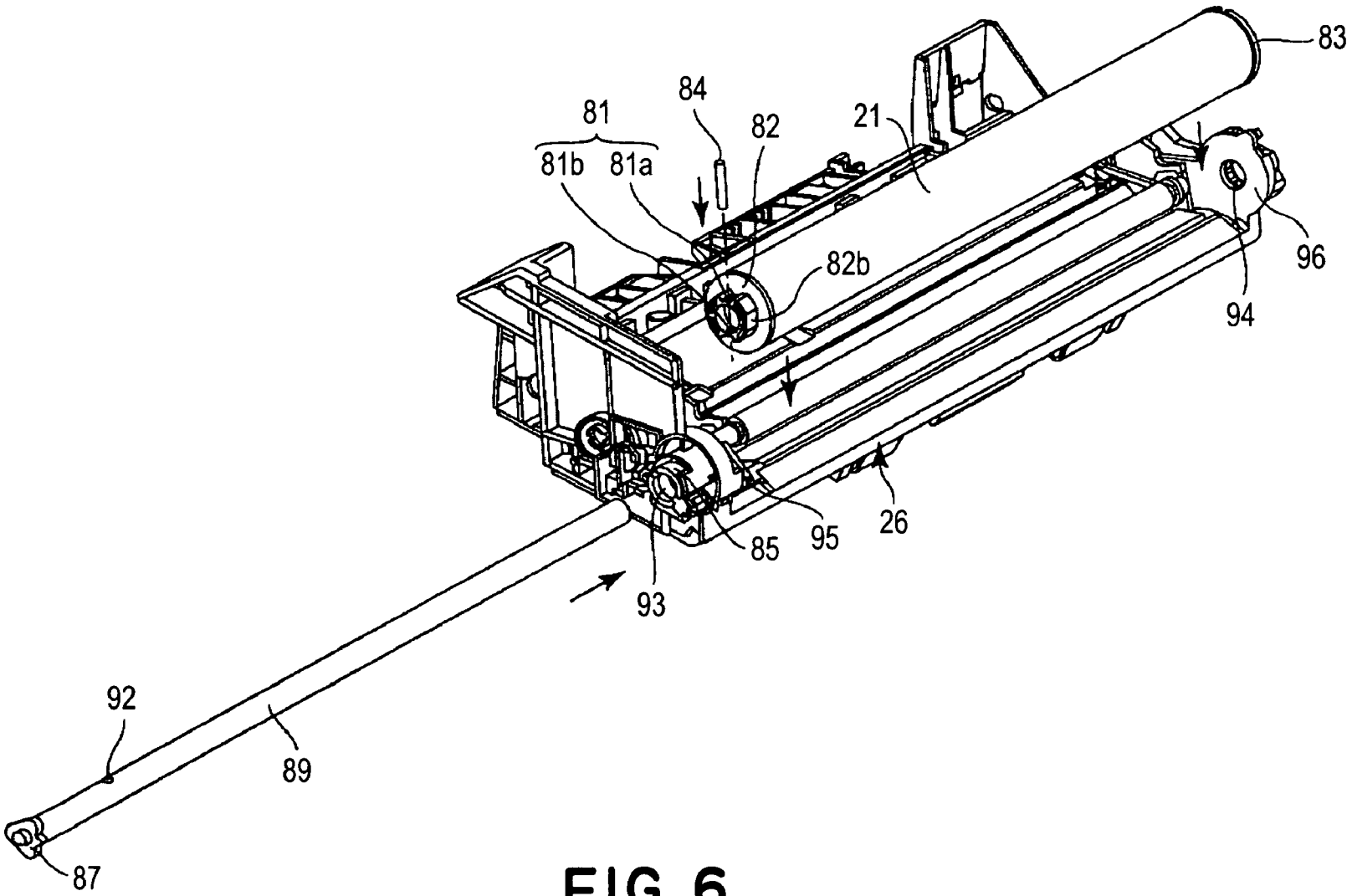
FIG. 6 is a schematic perspective view for illustrating mounting of the photosensitive drum.
Figure 7:
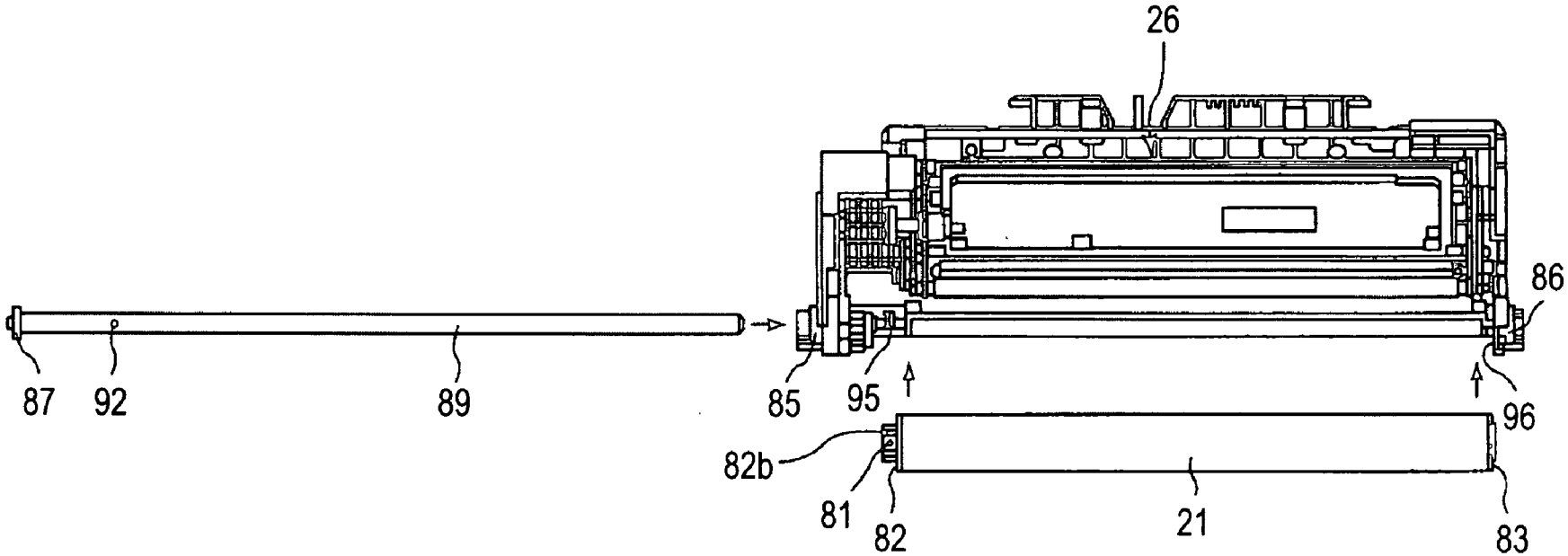
FIG. 7 is a top view for illustrating mounting of the photosensitive drum.

FIG. 4 shows the drum frame 26 in such a state that the photosensitive drum 21 is mounted to the drum frame 26 and is a view showing a state that the drum frame 26 shown in FIG. 3 is turned upside down. FIG. 5 is a sectional view showing the structure of the photosensitive drum 21. FIGS. 6 and 7 are a schematic perspective view and a top view, respectively, for illustrating the mounting method of the photosensitive drum 21 to the drum frame 26.

As shown in FIG. 5, the drum frame 26 is provided with a longitudinal frame regulating portion (drive side) 95 and a longitudinal frame regulating portion (nondrive side) 96 at both longitudinal ends of the photosensitive drum mounting portion.

As shown in FIGS. 5 to 7, at both ends of the photosensitive drum 21, a drum flange (drive side) 82 and a drum flange (non-drive side) 83 are connected, respectively. The photosensitive drum 21 is inserted into and disposed in an area sandwiched between the longitudinal frame regulating portion (drive side) 95 and the longitudinal frame regulating portion (non-drive side) 96. As a result, positioning of the photosensitive drum 21 in the longitudinal direction is performed. The longitudinal frame regulating portion (drive side) 95 is a projection provided to the drum frame 26, and the longitudinal frame regulating portion (non-drive side) 96 is an inner surface of the drum frame 26. This inner surface regulates the entire cross section (a plane as seen is the longitudinal direction) of the drum flange (non-drive side) 83. On the other hand, the projection regulates a part of the cross section (a plane as seen in the longitudinal direction) of the drum flange (drive side) 82. By such an arrangement, the mounting of the photosensitive drum 21 and the positioning thereof in the longitudinal direction become easy.

Next, the photosensitive drum 21 is positionally aligned so that center cylindrical holes of the drum flange (drive side) 82 and the drum flange (non-drive side) 83 at both ends thereof are aligned with a frame opening (drive side) 93 and a frame opening (non-drive side) 94, respectively.

Next, a drum shaft 89 is inserted from the frame opening (drive side) 93 of the drum frame 26. At this time, the drum shaft 89 is inserted so that the leading end of the drum shaft 89 in the insertion direction is penetrated through the frame opening (drive side) 93, an opening 82*a* of the drum flange (drive side) 82, an opening 83*a* of the drum flange (non-drive side) 83, and the frame opening (non-drive side) 94 in this order. The insertion operation of the drum shaft 89 is performed until a drum shaft through hole 92 provided in the drum shaft 89 is aligned with a drum flange through hole 81 provided in the drum flange (drive side) 82. The drum shaft through hole 92 is provided in a direction perpendicular to the longitudinal direction of the drum shaft 89. The drum flange through hole 81 comprises a first opening 81*a* and a second opening 81*b* which are provided opposite to each other at a periphery of the flange opening 82*a*. These first and second openings 81*a* and 81*b* are provided in a direction perpendicular to the longitudinal direction of the photosensitive drum 21. The drum flange (drive side) 82 is provided with a projection 82*b* which is projected toward the opposite side from a connecting portion thereof with the photosensitive drum 21. The projection 82*b* penetrates the opening 82*a* of the drum flange (drive side) 82, whereby the connection of the drum shaft 89 with the photosensitive drum 21 is further stabilized. Further, the first opening 81*a* and the second opening 81*b* are provided so that they are penetrated by the projection 82*b* from its outer surface toward the opening 82*a*.

At that time, phases of the drum shaft through hole 92 and the drum flange through hole 81 are adjusted in advance so that the drum shaft through hole 92 and the drum flange through hole 81 are aligned with each other. More specifically, the phases are preliminarily adjusted so that the drum shaft through hole 92 and the drum flange through hole 81 are directed in a vertical direction with respect to the drawing sheet of FIG. 7.

Then, as shown in FIG. 5, a press-in pin 84 as the connecting member is penetrated through the first opening 81*a*, the drum shaft through hole 92, and the second opening 81*b* to be press-fitted therein, whereby the photosensitive drum 21 and the drum shaft 89 are connected with each other to complete the mounting of the photosensitive drum 21 to the drum frame 26. The press-in pin 84 is made of a metal. As a result, the connection between the photosensitive drum 21 and the drum shaft 89 is effected with reliability.

As described above, the positioning and the connection between the photosensitive drum 21 and the drum shaft 89 in the axial direction and the rotation direction are performed through press-fitting. Further, the regulation of the photosensitive drum 21 by the drum frame in the axial direction is effected by the longitudinal frame regulating portion (drive side) 95 and the longitudinal frame regulating portion (non-drive side) 96 which are provided to the drum frame 26. By doing so, the photosensitive drum 21 is positioned on the drum frame 26 only with the press-in pin 84.

As a result, it becomes possible to obviate the need for forming a locking groove for use in an E type retaining ring (a locking member) or the like, on the drum shaft 89. Further, it is possible to reduce the sized of the process cartridge 20 in the axial direction of the photosensitive drum 21. Further, it becomes possible to simplify an assembly step of the process cartridge 20. In addition, it becomes possible to realize a cost reduction by reducing the number of parts of the process cartridge. In addition, it is possible to provide a process cartridge 20 capable of positioning the photosensitive drum 21 on the drum frame 26 only through press-fitting of the press-in pin 84 as the connecting member.

As described above, the drum frame 26 to which the photosensitive drum 21 is mounted is connected to the development frame, i.e., the development container 27 with the fixing pin 29 to assemble the process cartridge 20.

Next, the above assembled process cartridge 20 and the photosensitive drum 21 will be further described.

Figure 8:
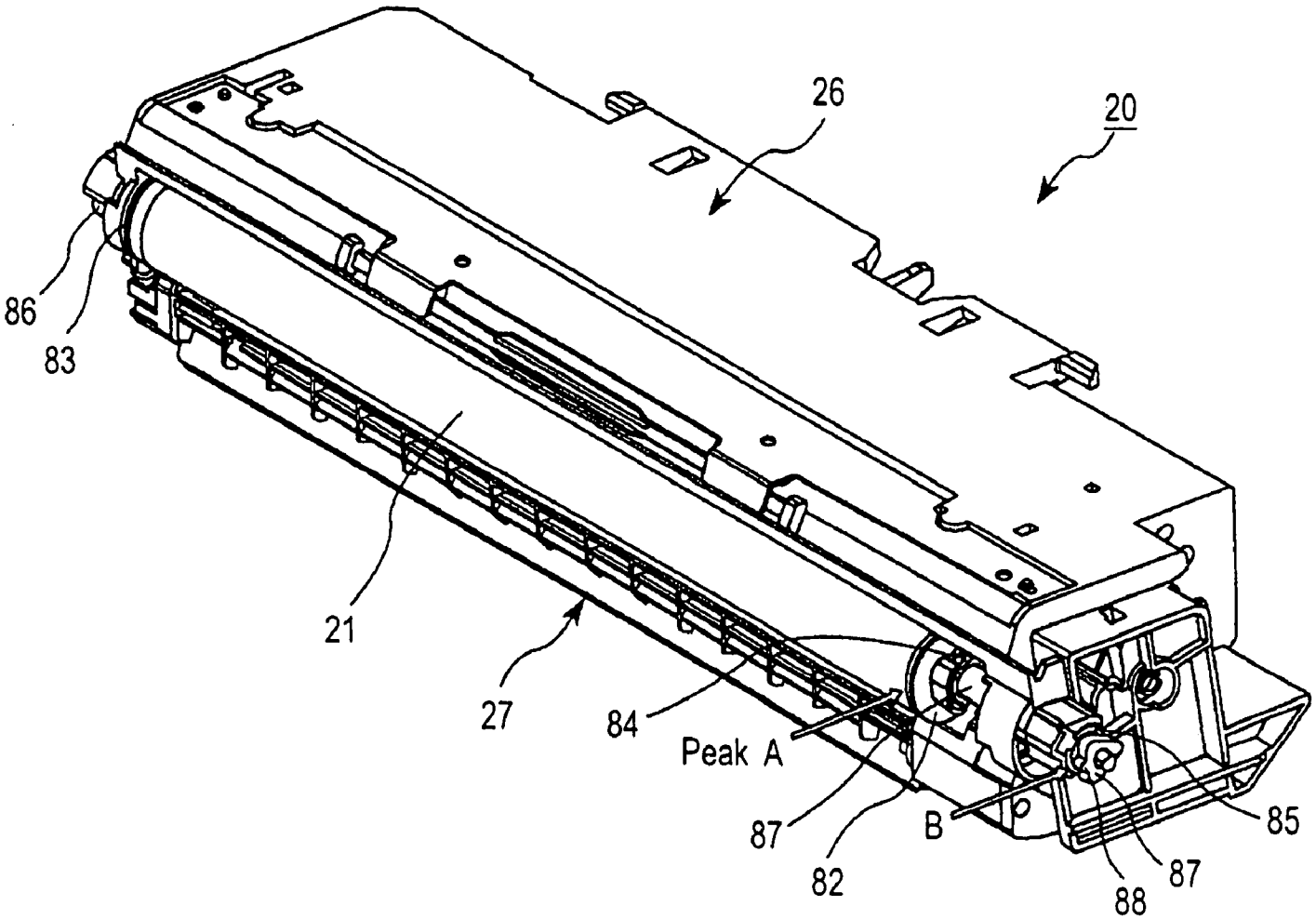
FIG. 8 is a perspective view of a process cartridge according to an embodiment of the present invention.

FIG. 8 is a perspective view of the process cartridge 20 assembled as described above, and FIGS. 9 and 10 are side views of the process cartridge 20.

At one end of the drum shaft 89 of the drum frame 26, a coupling 87 is provided for receiving a driving force, for rotating the photosensitive drum 21, from the printer main assembly B. Further, at the one end of the drum shaft 89, a bearing 85 as a process cartridge positioning portion is disposed to be projected.

The photosensitive drum 21 has, as described with reference to FIG. 5, the hollow drum cylinder surface-coated with the photosensitive layer. At both ends of the photosensitive drum 21, the drum flanges 82 and 83 are connected mechanically. At the centers of the drum flanges 82 and 83, the cylindrical openings 82*a* and 83*a* are provided, and the drum shaft 89 is engaged in the flange center openings 82*a* and 83*a*. The drum shaft 89 is projected from the drum flanges 82 and 83 at both its ends. Further, the drum shaft 89 is connected to the drum flange 82 with the press-in pin 84, as described above.

The photosensitive drum 21 is mounted to the drum frame 26 in the above described manner. The drum shaft 89 is held by the drum frame 26 by the bearings 85 and 86 outside the drum frame 26.

Thereafter, as shown in FIG. 8, in a mounted state of the process cartridge 20, surface run out of the photosensitive drum 21 is measured while rotating the photosensitive drum 21. The photosensitive drum 21 is stopped when the run out reaches a peak position (Peak A). In this state, the coupling 87 is press-fitted to a position indicated by an arrow B so that a shape 88, which unambiguously determines the position of the metal coupling 87, has a certain phase with respect to the Peak A position described above.

Figure 10:
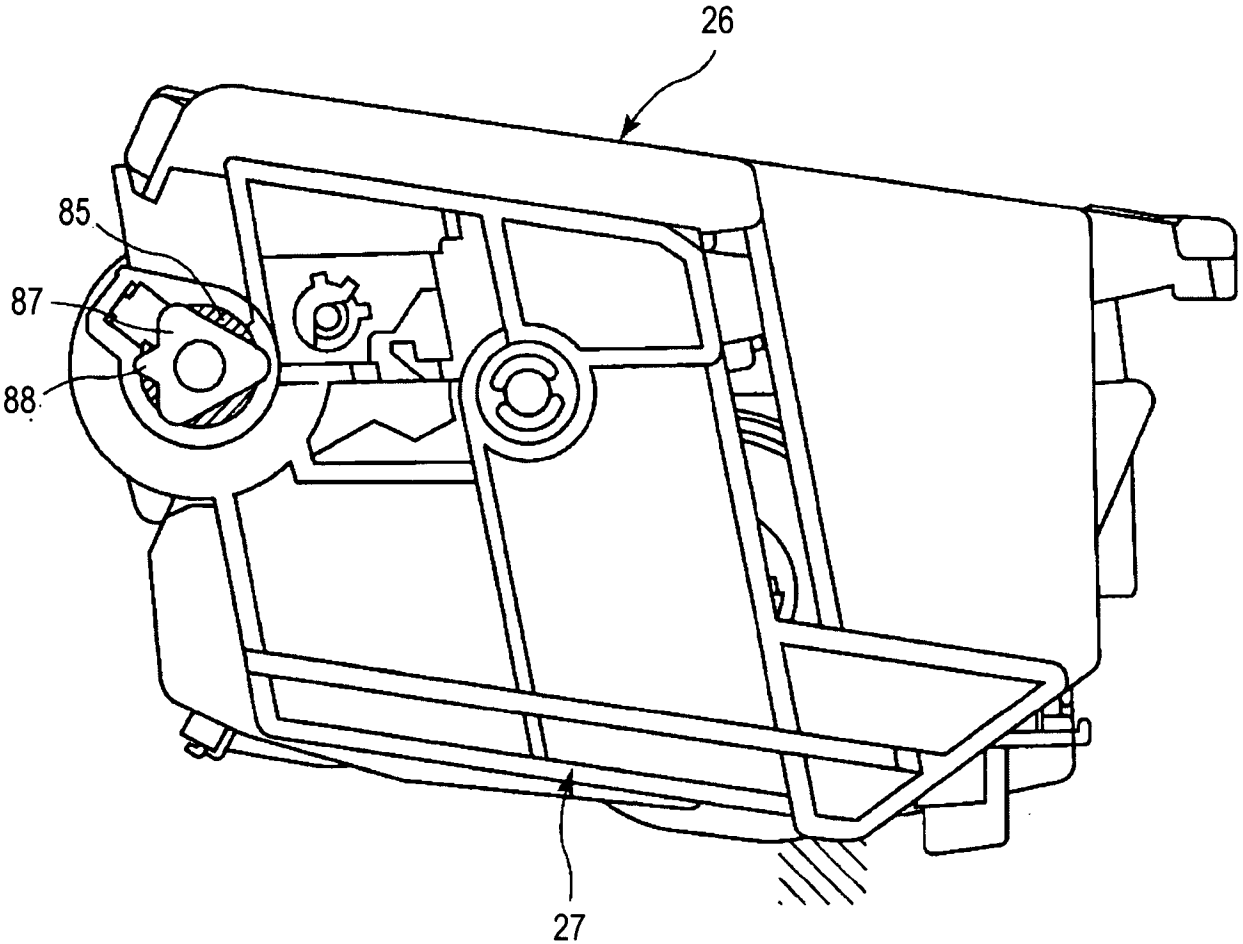
FIG. 10 is left side view of the process cartridge.

As shown in FIG. 10, the surface of the drum bearing 85 is exposed and projected toward its lower surface side and the leading end side of the process cartridge in the mounting direction.

Figure 9:
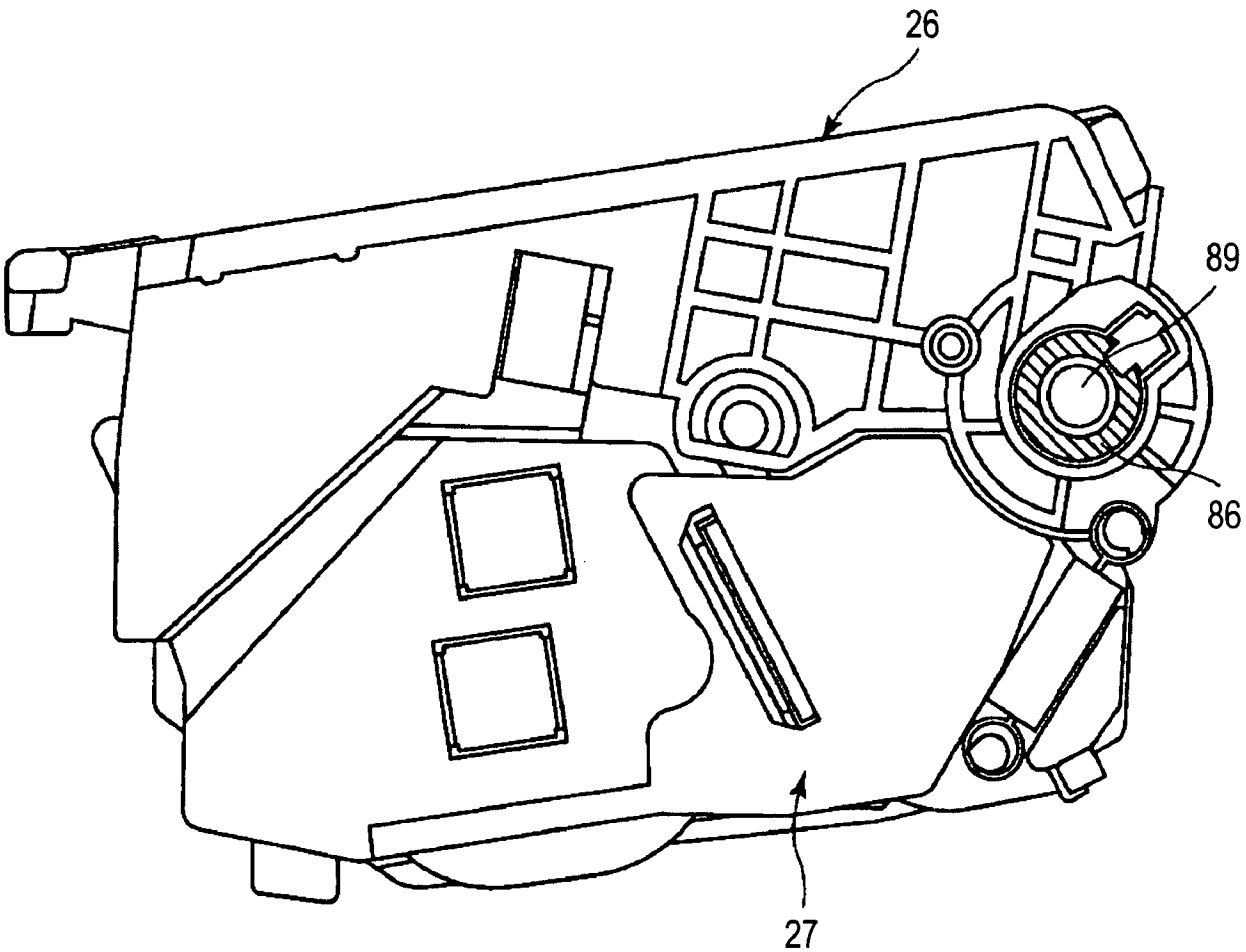
FIG. 9 is a right side view of the process cartridge.

Further, as shown in FIG. 9, similarly on the other end side, the bearing 86 as the positioning portion of the process cartridge is disposed to be projected. Specifically, the bearing 86 is also exposed and projected toward its lower surface side and the leading end side of the process cartridge in the mounting direction.

In this embodiment, as the bearings 85 and 86, a slide bearing is used but a roller bearing may also be used. Further, it is also possible to use a resinous bearing formed integrally with the drum frame 26.

[Fixing Method of Process Cartridge in Main Assembly]

Figure 11:
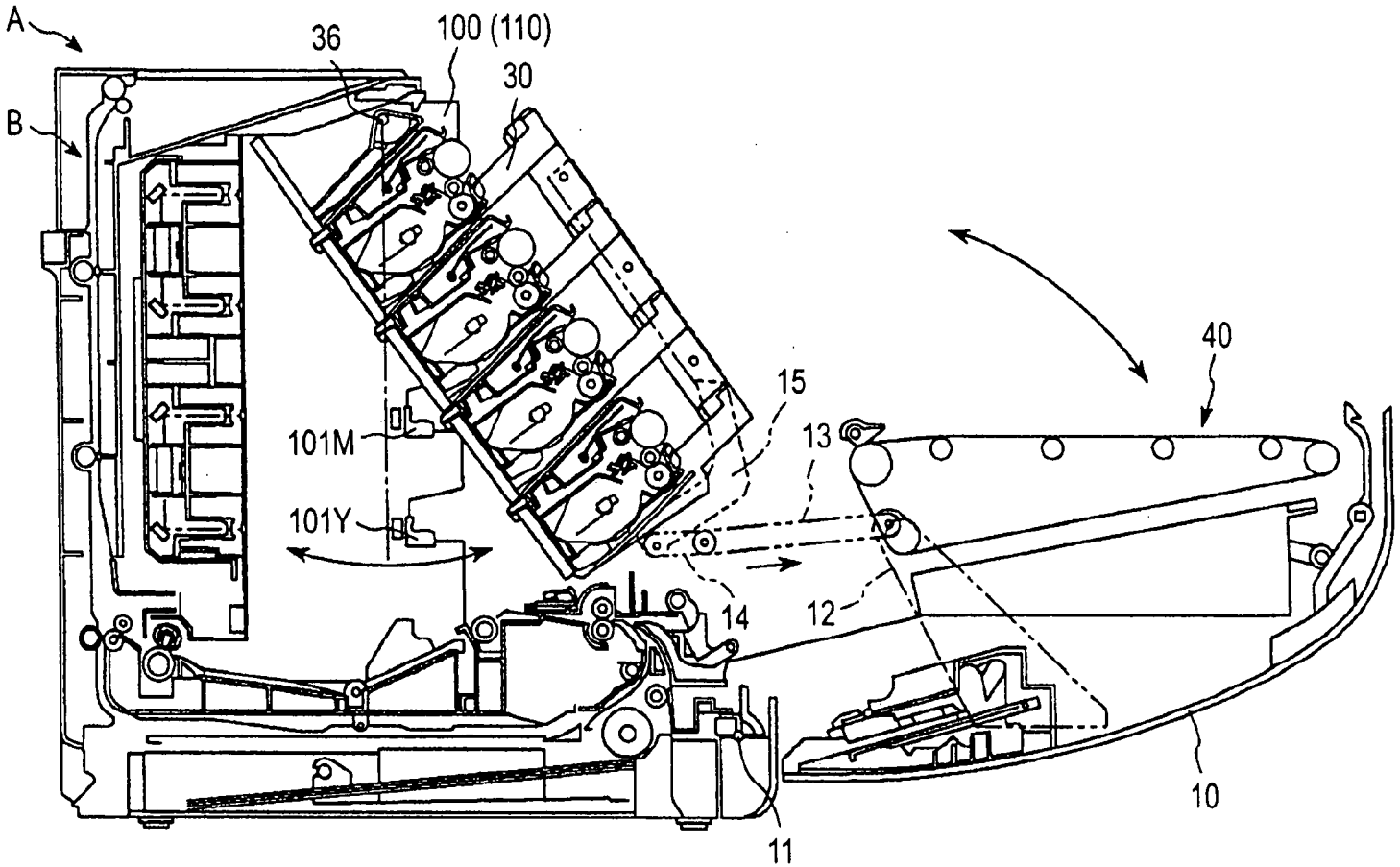
FIG. 11 is a schematic sectional view showing an opened state of an opening and closing cover of an image forming apparatus according to an embodiment of the present invention.

FIG. 11 is a schematic sectional view of an opening and closing door 10 of the image forming apparatus when the door 10 is opened.

Referring to FIG. 11, in this embodiment, the intermediary transfer member unit 40 is mounted to the main assembly opening and closing door 10. Accordingly, the intermediary transfer member unit 40 is integrally rotated with the opening and closing operation of the door 10.

On the other hand, the process cartridges 20 (20Y, 20M, 20C and 20K) are mounted on a holding member 30. The holding member 30 is connected to the main assembly opening and closing door 10 with links 12, 13, 14 and 15 indicated by chain double-dashed lines. Accordingly, the holding member 30 is rotationally moved, by the rotation of the door 10 about a spindle point 11, to an angle at which the process cartridges 20 (20Y, 20M, 20C and 20K) are inclined so as to be readily removed.

In FIG. 11, on a main assembly right side plate 100, as is understood by reference to also FIGS. 12 and 13, process cartridge abutting members (101Y, 101M, 101C and 101K) for the right side plate 100 are disposed. Similarly, on a main assembly left side plate 110, process cartridge abutting members (103Y, 103MM 103C and 103K) for the left side plate 110 are disposed.

FIG. 12 schematically shows a state that the position of the process cartridge 20Y is determined. The coupling of a main assembly drive gear is moved and engaged in a direction of a double-pointed arrow in synchronism with the opening and closing operation of the door 10. FIG. 13 is a perspective view showing a supporting state for the photosensitive drums 21 (21Y, 21M, 21C and 21K) in the four stations.

The process cartridge abutting members for the right and left side plates 100 and 110 are adjusted and assembled to be fixed to the right and left side plates 100 and 110, respectively. By doing so, it is possible to maintain parallelism of the drum shafts 89, for the respective colors, of the respective process cartridges 20 with high accuracy.

The process cartridge abutting members for locking the projected cartridge positioning portions of the process cartridges 20, i.e., the bearings 85 and 86 are disposed on the surfaces of the main assembly side plates or inside the apparatus in a projected state.

When the main assembly opening and closing door 10 is closed, the process cartridges 20 (20Y, 20M, 20C and 20K) mounted on the holding member 30 are integrally moved to corresponding image forming positions shown in FIG. 1.

At this time, the process cartridge abutting members are disposed, as planar members, at two positions in a horizontal direction and a vertical direction, respectively. With these two planar members, each of the bearings of the projected right and left process cartridge positioning portions 85 and 86 is directly in contact.

As described above, when the drum frames 26 for the respective colors are directly supported by the main assembly side plates 100 and 110, the bearings 85 and 86 of the drum shaft 89 are directly supported, whereby the positions of the photosensitive drums 21 in the four stations are determined in the main assembly with accuracy.

[Main Assembly Drive Gear Train]

In the image forming apparatus according to this embodiment, the drive of the photosensitive drums 21 in the four stations is performed by a single motor.

Figure 14:
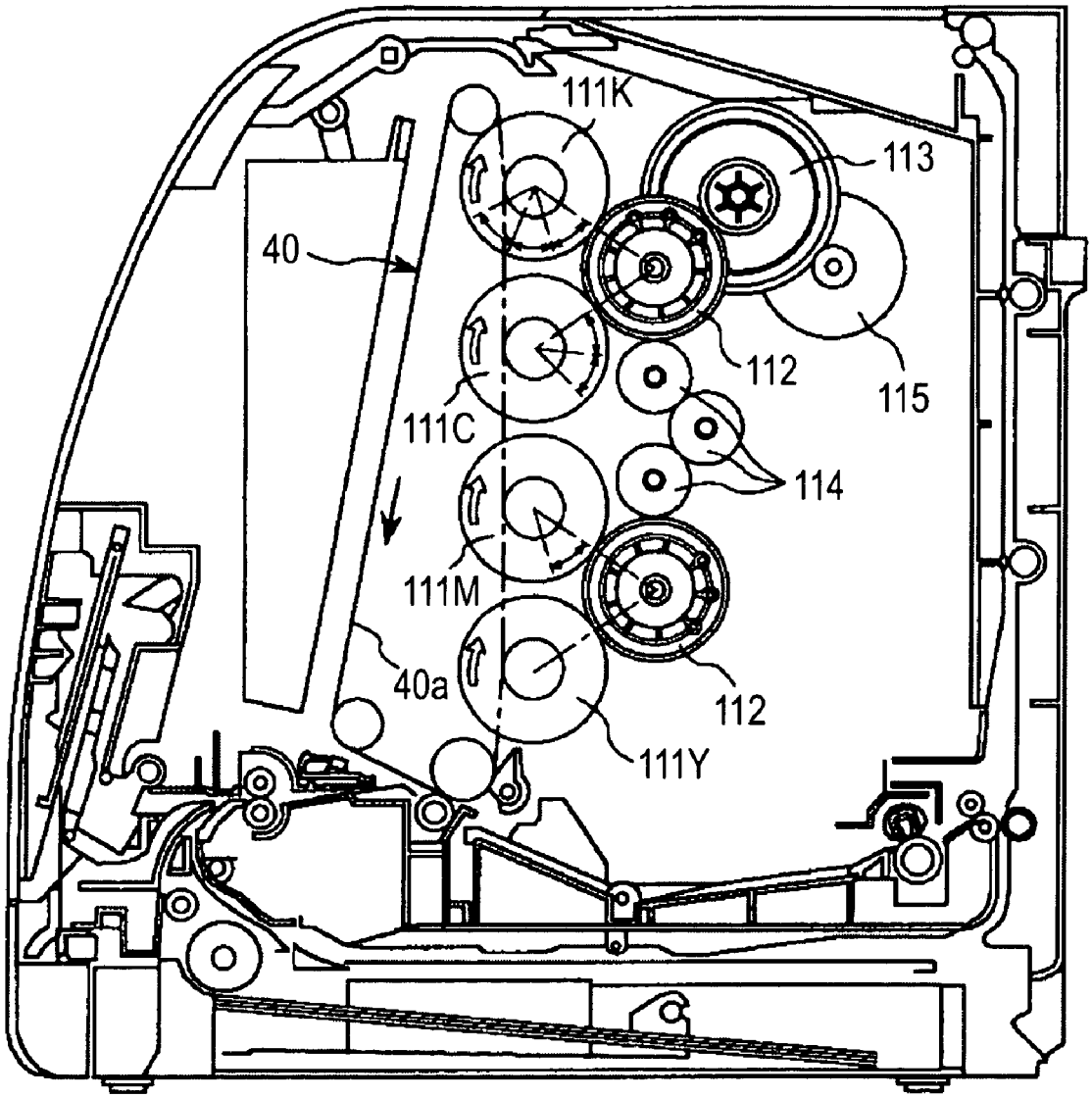
FIG. 14 is a schematic side view, of an image forming apparatus main assembly, showing a gear train used in an embodiment of the present invention.
Figure 15:
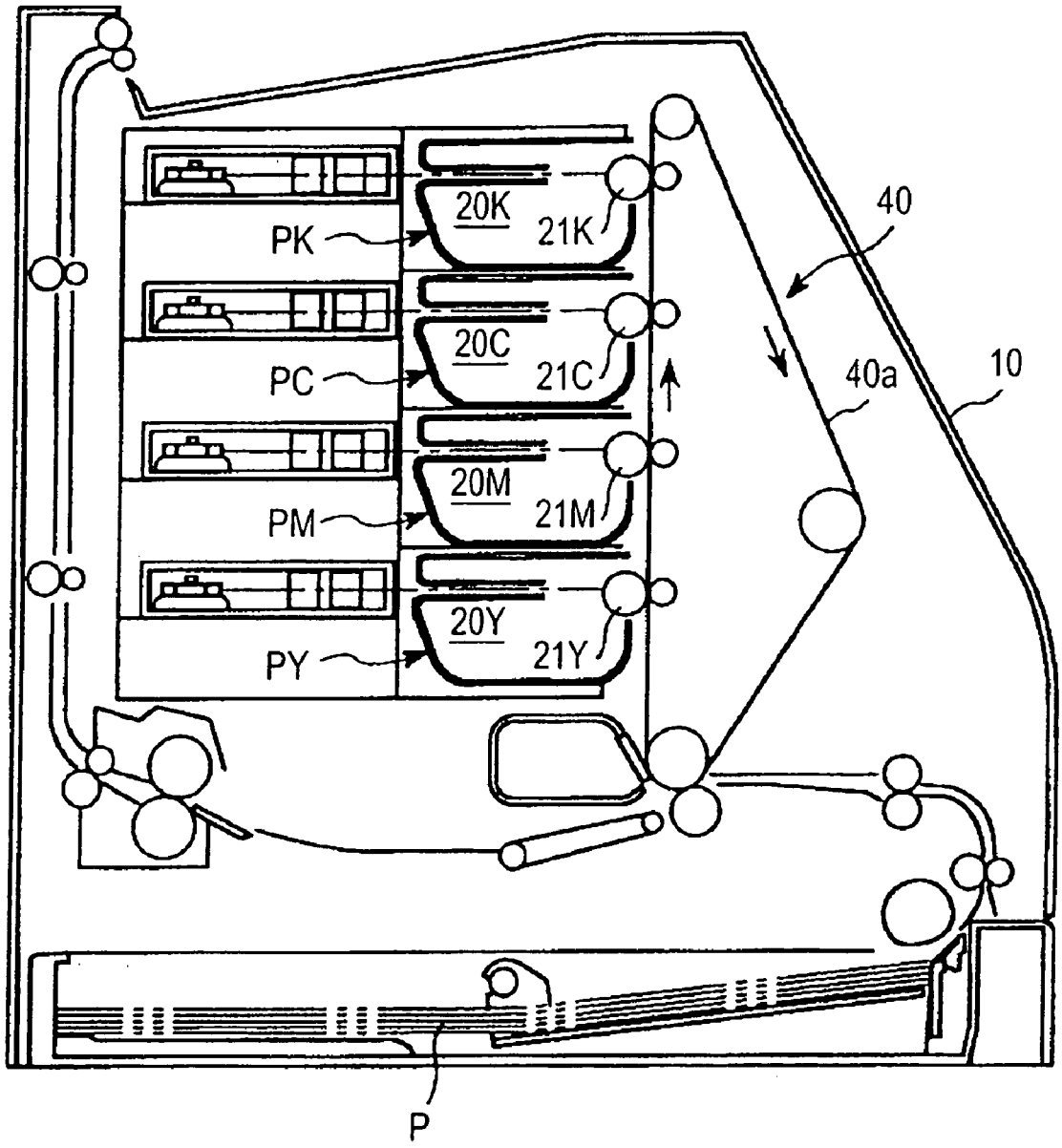
FIG. 15 is a schematic sectional view showing a schematic structure of a conventional image forming apparatus.

Referring to FIGS. 13 and 14, a rotation force is transmitted from a motor 115 to four drum drive gears 111Y, 111M, 111C and 111K through a group of gear trains 112, 113 and 114.

The four drum drive gears 111Y, 111M, 111C and 111K are prepared through molding in order to realize a cost reduction. There is a possibility that a rotation irregularity in the drum rotation period is caused to occur depending on a drum gear accuracy in terms of a pitch error or the like in the molding. In order to alleviate the pitch error, the drum drive gears are mounted to have a predetermined difference in angle by effecting marking on the gears so that the rotation irregularity periods of the drum drive gears have the same phase at the timing when an image is formed in the respective stations, as shown in FIG. 14.

Embodiment 2

The replacing method of the photosensitive drum 21 will be described in this embodiment.

When the developer in the process cartridge 20 is consumed and the process cartridge 20 which has no commercial value is again commercialized, i.e., when refurbishing of the process cartridge 20 is effected, the photosensitive drum 21 is replaced in some cases.

The following replacing method of the photosensitive drum is effective in such cases.

The replacement of the photosensitive drum 21 can be effected through the operation procedure at the time of mounting the photosensitive drum to the drum frame as described in Embodiment 1 with reference to, e.g., FIGS. 5 to 7, in reverse order.

More specifically, the replacing method of replacing the electrophotographic photosensitive drum mounted in the process cartridge which is detachably mountable to the main assembly of the electrophotographic image forming apparatus comprises the following steps (a) to (e):

(a) a connecting member pulling step of pulling out the pin or connecting member 84 which is penetrated through the through hole 92 provided in the drum shaft 89 in a direction perpendicular to the longitudinal direction of the drum shaft 89 and the through holes 81 (the first opening 81*a* and the second opening 81*b*) which are provided opposite from each other in a periphery of a first end flange opening, which is provided in the drum or first end flange 82 at a first end of the electrophotographic photosensitive drum 21, for permitting penetration of the drum shaft 89 therethrough, (b) a drum shaft pulling step of pulling out the drum shaft which is penetrated through the non-drive side frame or second end opening 94 provided in the drum frame 26 from the outside of a second longitudinal end of the drum frame 26 to the second longitudinal end of the drum frame 26, the electrophotographic photosensitive drum 21, and the drive-side frame or first end opening 93 provided at a first longitudinal end of the drum frame 26, and a drum removal step of removing the electrophotographic photosensitive drum 21 from the drum frame 26, (c) a drum position regulation step of regulating a first end of a new electrophotographic photosensitive drum 21 by the drive-side or first end frame regulating portion 95 and a second end of the new electrophotographic photosensitive drum 21 by the non-drive side or second end frame regulating portion 96 to effect regulation of the electrophotographic photosensitive drum 21 in its longitudinal direction with respect to the drum frame 26, (d) a drum supporting step of supporting the new electrophotographic photosensitive drum 21 on the drum frame 26 by penetrating the drum shaft 89 from the outside of the second longitudinal end of the drum frame 26 through the second end opening 94, the new electrophotographic photosensitive drum 21, and the first end opening 93, and (e) a drum mounting step of mounting the new electrophotographic photosensitive drum 21 to the drum frame 26 by penetrating the connecting member 84 through the through hole 92 of the drum shaft 89, the first opening 81*a*, and the second opening 81*b* to mount the drum shaft 89 in the new electrophotographic photosensitive drum 21.

According to the drum replacing method of this embodiment, as the connecting member 84, such as a pin, and the drum shaft 89, those used for mounting the removed photosensitive drum 21 can be reused. Further, it is also possible to reuse the connecting member 84 and the drum shaft 89 removed from another process cartridge or use a new connecting member and a new drum shaft 89.

As described above, according to the drum replacing method of the present invention, the positioning and connection between the photosensitive drum 21 and the drum shaft 89 in the axial and rotation directions are effected by press-fitting of the press-in pin 84, and the regulation of the photosensitive drum 21 by the drum frame 26 in the axial direction is effected by the longitudinal frame regulating portion (drive side) 95 and the longitudinal frame regulating portion (non-drive side) 96 which are provided to the drum frame 26, whereby the position of the photosensitive drum 21 is determined on the drum frame 26 only with the use of the press-in pin 84.

Accordingly, the replacement of the photosensitive drum 21 is considerably simplified and can be readily and quickly performed.

The drum frame 26 including the photosensitive drum 21 which has been replaced by the above described replacing method is connected to the development container 27 with the fixing pin 29, whereby the process cartridge is assembled.

According to the present invention, it becomes possible to reduce the size of the photosensitive drum of the process cartridge in the longitudinal direction of the photosensitive drum.

According to the present invention, it is also possible to reduce the number of parts for the process cartridge. Further, it is possible to simplify the assembly steps of the process cartridge.

What is claimed is:

1. A process cartridge detachably mountable to a main assembly of an electrophotographic image forming apparatus, comprising:

an electrophotographic photosensitive drum;

a process device actable on said electrophotographic photosensitive drum;

a drum frame rotatably supporting said electrophotographic photosensitive drum;

a first drum frame opening provided at a first longitudinal end of said drum frame;

a second drum frame opening provided at a second longitudinal end of said drum frame;

a first end regulating portion provided at the first longitudinal end of said drum frame;

a second end regulating portion provided at the second longitudinal end of said drum frame;

a drum shaft which penetrates through said electrophotographic photosensitive drum to be engaged with said first drum frame opening and said second drum frame opening and is provided with a through hole extending in a direction perpendicular to the longitudinal direction of said drum shaft;

a first end flange provided at a first end of said electrophotographic photosensitive drum;

a first end flange opening in said first end flange, configured and positioned to permit penetration of said drum shaft therethrough;

a first opening and a second opening which are provided opposite from each other at a periphery of said first end flange and which open in a direction perpendicular to a longitudinal direction of said electrophotographic photosensitive drum; and a connecting member which penetrates through said first opening and said through hole and engages said second opening to connect said electrophotographic photosensitive drum with said drum shaft, wherein said first end regulating portion and said second end regulating portion regulate a position of said electrophotographic photosensitive drum in its longitudinal direction and said connecting member connects said drum shaft with said electrophotographic photosensitive drum so that said electrophotographic photosensitive drum is rotatably supported by said drum frame with said drum shaft, wherein said first end regulating portion has a first configuration which is provided at the first longitudinal end of said drum frame and regulates a position of an end surface of said first end flange, and wherein said second end regulating portion has a second configuration, is located at the second longitudinal end of said drum frame, and regulates a position of an end surface of a second end flange provided at a second end of said electrophotographic photosensitive drum.

2. A process cartridge detachably mountable to a main assembly of an electrophotographic image forming apparatus, comprising:

an electrophotographic photosensitive drum;

a process device actable on said electrophotographic photosensitive drum;

a drum frame rotatably supporting said electrophotographic photosensitive drum;

a first drum frame opening provided at a first longitudinal end of said drum frame;

a second drum frame opening provided at a second longitudinal end of said drum frame;

a first end regulating portion provided at the first longitudinal end of said drum frame;

a second end regulating portion provided at the second longitudinal end of said drum frame;

a drum shaft which penetrates through said electrophotographic photosensitive drum to be engaged with said first drum frame opening and said second drum frame opening and is provided with a through hole extending in a direction perpendicular to the longitudinal direction of said drum shaft;

a first end flange provided at a first end of said electrophotographic photosensitive drum;

a first end flange opening in said first end flange, configured and positioned to permit penetration of said drum shaft therethrough;

a first opening and a second opening which are provided opposite from each other at a periphery of said first end flange and which open in a direction perpendicular to a longitudinal direction of said electrophotographic photosensitive drum; and a connecting member which penetrates through said first opening and said through hole and engages said second opening to connect said electrophotographic photosensitive drum with said drum shaft, wherein said first end regulating portion and said second end regulating portion regulate a position of said electrophotographic photosensitive drum in its longitudinal direction and said connecting member connects said drum shaft with said electrophotographic photosensitive drum so that said electrophotographic photosensitive drum is rotatably supported by said drum frame with said drum shaft, wherein said first end flange has a projected portion, wherein said first end flange opening penetrates through said projected portion, and wherein said first and second openings are provided so as to penetrate through said projected portion from an outer surface of said projection portion toward said first end flange opening.

3. A mounting method of mounting an electrophotographic photosensitive drum to a drum frame of a process cartridge which is detachably mountable to a main assembly of an electrophotographic image forming apparatus, comprising:

a drum positioning step of effecting positioning of the electrophotographic photosensitive drum in its longitudinal direction on the drum frame by regulating a first end of the electrophotographic photosensitive drum with a first end regulating portion and regulating a second end of the electrophotographic photosensitive drum with a second end regulating portion;

a drum supporting step of supporting the electrophotographic photosensitive drum on the drum frame by penetrating a drum shaft through the drum frame from the outside of one longitudinal end of the drum frame through a first end opening provided at a first longitudinal end of the drum frame, and through a second end opening provided at a second longitudinal end of the drum frame; and a drum shaft mounting step of mounting a drum shaft in the electrophotographic photosensitive drum by penetrating a connecting member through a through hole provided in the drum shaft in a direction perpendicular to a longitudinal direction of the drum shaft, and a first opening and a second opening which are provided opposite from each other in a periphery of a first end flange opening, which is provided in a first end flange at a first end of the electrophotographic photosensitive drum, for permitting penetration of the drum shaft therethrough, wherein in said drum positioning step, the positioning of the electrophotographic photosensitive drum in its longitudinal direction on the drum frame is effected by regulating a position of an end surface of the first end flange with the first end regulating portion having a first configuration, provided at the drum frame and by regulating a position of an end surface of a second end flange, provided at the second end of the electrophotographic photosensitive drum, with the second end regulating portion having a surface of the drum frame having a second configuration located at the second longitudinal end of the drum frame.

4. A cartridge according to claim 1, said first configuration regulates a part of a cross section of said first end flange, and said second configuration regulates an entire cross section of said second end flange.

5. A cartridge according to claim 1, wherein said first configuration comprises a projection, said projection protruding from said drum frame and regulating a part of a cross section of said first end flange, and said second configuration has an inner surface of said drum frame, said inner surface regulating an entire cross section of said second end flange.

6. A mounting method according to claim 3, said first configuration regulates a part of a cross section of said first end flange, and said second configuration regulates an entire cross section of said second end flange.

7. A mounting method according to claim 3, wherein said first configuration comprises a projection, said projection protruding from said drum frame and regulating a part of a cross section of said first end flange, and said second configuration has an inner surface of said drum frame, said inner surface regulating an entire cross section of said second end flange.

* * * * *

UNITED STATES PATENT AND TRADEMARK OFFICE

CERTIFICATE OF CORRECTION

PATENT NO. : 7,158,735 B2
APPLICATION NO. : 10/875200
DATED : January 2, 2007
INVENTOR(S) : Kazunari Murayama et al.

It is certified that error appears in the above-identified patent and that said Letters Patent is hereby corrected as shown below:

COLUMN 2:
Line 14, “cam” should read --can--.
Line 15, “objects” should read --object--.

COLUMN 6:
Line 9, “rotated” should read --rotated at--.

COLUMN 11:
Line 62, “sized” should read --size--.

Signed and Sealed this

Twenty-ninth Day of July, 2008

JON W. DUDAS
*Director of the United States Patent and Trademark Office*